US010415555B2

(12) United States Patent
Vemula et al.

(10) Patent No.: US 10,415,555 B2
(45) Date of Patent: Sep. 17, 2019

(54) BEVERAGE DISPENSER FOR POST MIX BEVERAGES

(71) Applicant: WELBILT INC., New Port Richey, FL (US)

(72) Inventors: Srikar Vemula, Wesley Chapel, FL (US); Kenneth L. Lundberg, Land O Lakes, FL (US); Patrick Baker, Valrico, FL (US); Paul Hanniffy, Trinity, FL (US); Dan Ionescu, Louisville, KY (US)

(73) Assignee: Welbilt Inc., New Port Richey, FL (US)

( * ) Notice: Subject to any disclaimer, the term of this patent is extended or adjusted under 35 U.S.C. 154(b) by 0 days.

(21) Appl. No.: 15/891,730

(22) Filed: Feb. 8, 2018

(65) Prior Publication Data

US 2018/0223818 A1 Aug. 9, 2018

Related U.S. Application Data

(60) Provisional application No. 62/456,394, filed on Feb. 8, 2017.

(51) Int. Cl.
*F04B 13/02* (2006.01)
*B67D 1/10* (2006.01)
(Continued)

(52) U.S. Cl.
CPC ..... *F04B 13/02* (2013.01); *B67D 1/0027* (2013.01); *B67D 1/0043* (2013.01);
(Continued)

(58) Field of Classification Search
CPC ..... F04B 13/02; B67D 1/0027
(Continued)

(56) References Cited

U.S. PATENT DOCUMENTS 2,458,230 A * 1/1949 Warcup ..... B08B 9/0323 137/238
3,015,420 A 1/1962 Chudnow
(Continued)

FOREIGN PATENT DOCUMENTS

GB 2163531 A 2/1986
GB 2232228 A 12/1990
(Continued)

OTHER PUBLICATIONS

International Search Report dated May 4, 2018 for PCT application No. PCT/US2018/017371.
(Continued)

*Primary Examiner* — Vishal Pancholi
(74) *Attorney, Agent, or Firm* — Ohlandt, Greeley, Ruggiero & Perle, L.L.P.

(57) ABSTRACT

A beverage dispenser includes a dispenser housing having a first inlet, a piston being disposed in the dispenser housing, with the piston having a chamber extending through the piston, where the piston is movable in the dispenser housing between an open position and a closed position. The first inlet is in fluid communication with the chamber when in the open position. The first inlet is blocked from fluid communication with the chamber when in the closed position.

8 Claims, 28 Drawing Sheets

(51) Int. Cl.
*B67D 1/00* (2006.01)
*B67D 1/14* (2006.01)

(52) U.S. Cl.
CPC ..... *B67D 1/0044* (2013.01); *B67D 1/0086* (2013.01); *B67D 1/102* (2013.01); *B67D 1/1438* (2013.01); *B67D 2001/0089* (2013.01)

(58) Field of Classification Search
USPC ..... 222/129.1–129.4, 144.5, 145.1, 340
See application file for complete search history.

(56) References Cited

U.S. PATENT DOCUMENTS 3,272,404 A * 9/1966 Graves ..... B67D 1/0412 137/212
3,612,354 A * 10/1971 Sitton ..... B67D 1/1466 137/614.19
3,851,797 A 12/1974 Jacobs
4,562,013 A 12/1985 Jeans
4,863,068 A * 9/1989 Smith ..... B67D 1/005 222/129.1
5,601,210 A * 2/1997 Kelly ..... B67D 1/0082 137/625.4
6,019,257 A * 2/2000 Rasmussen ..... B67D 1/1422 222/400.7
6,564,971 B2 * 5/2003 Heyes ..... B01F 5/0471 222/129.1
2008/0189078 A1 8/2008 Vok et al.

FOREIGN PATENT DOCUMENTS

GB 2457434 A 8/2009
GB 2489953 A 10/2012
WO 2014092658 A1 6/2014

OTHER PUBLICATIONS

Written Opinion dated May 4, 2018 for PCT application No. PCT/US2018/017371.
International Preliminary Report on Patentability (IPRP) dated Mar. 5, 2019 for PCT application No. PCT/US2018/017371.

* cited by examiner

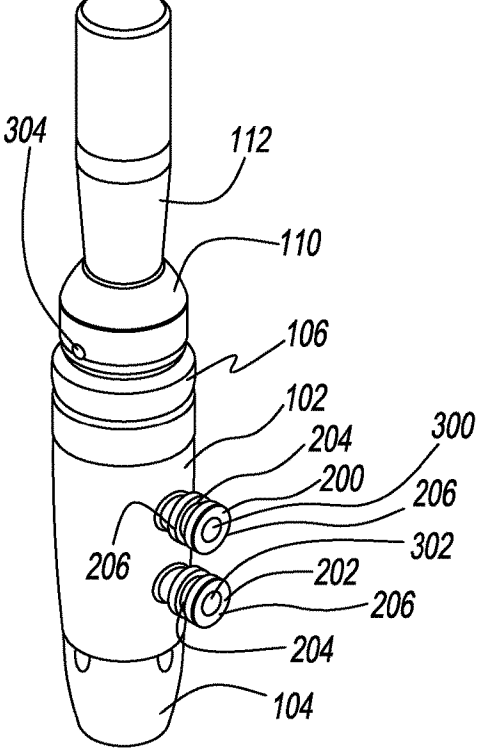
FIG. 1
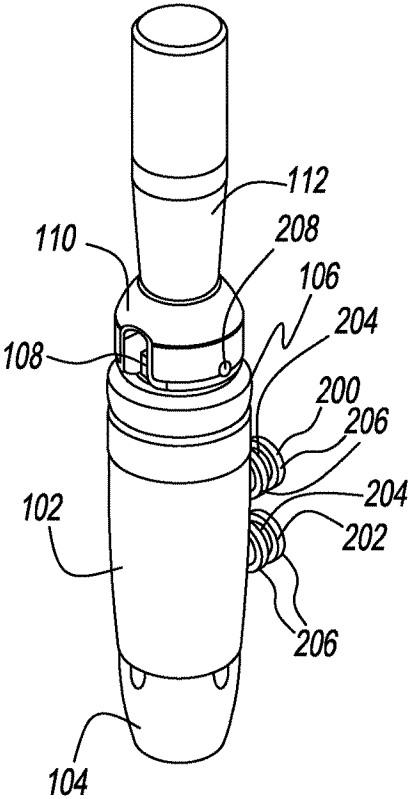
FIG. 2
FIG. 3

BEVERAGE DISPENSER FOR POST MIX BEVERAGES

This application claims the benefit of U.S. Provisional Application No. 62/456,394, filed Feb. 8, 2017. The contents of U.S. Provisional Application No. 62/456,394, filed Feb. 8, 2017, are hereby incorporated by reference herein in their entirety

BACKGROUND OF THE DISCLOSURE

1. Field of the Disclosure

The present disclosure relates to beverage dispensers for dispensing post mix beverages. More particularly, the present disclosure relates to a dispensing valve embodied as a tap, when operating dispenses one or more fluids, and, when there are at least two different fluids, the dispensing valve mixes them before the point of dispense.

2. Description of the Related Art

Traditional post mix dispense valves are large and require a unit to mount the valves, which can take additional space in a store. These valves are typically made from mostly plastic with a small overlay label showing the product that is being dispensed. This set up can be non-striking or lack luster when dispensing specialty/premium beverages alongside regular standard beverage products. They also generally require an electrically operated solenoid for each ingredient line to initiate flow. These solenoids generally create an undesirable noise during activation, further detracting from the appeal of the traditional design.

Traditional beer taps/faucets are noticeable to consumers in a store but they are mostly crew served application and mostly designed to dispense only one fluid at a time, and therefore are not designed for use with a typical bag-in-box post-mix system, which requires simultaneous dispensing of multiple flavors from a single dispense point. Traditional taps/faucets can be used for beverages having multiple flavors, but this requires premixing of the beverage before being dispensed. Pre-mixing occurs when the multiple flavors of the beverage are mixed prior to flowing into the traditional taps/faucets. Pre-mixing the beverage deteriorates the quality and performance of the beverage, e.g., loss of carbonation on dispense, excess foaming and loss of product through foaming. Accordingly, the user experience can also be negatively impacted.

Accordingly, there is a need to address these disadvantages of currently available systems.

SUMMARY OF THE DISCLOSURE

A beverage dispenser includes a dispenser housing having a first inlet, a piston being disposed in the dispenser housing, with the piston having a chamber extending through the piston, where the piston is movable in the dispenser housing between an open position and a closed position. The first inlet is in fluid communication with the chamber when in the open position. The first inlet is blocked from fluid communication with the chamber when in the closed position.

The above-described and other advantages and features of the present disclosure will be appreciated and understood by those skilled in the art from the following detailed description, drawings, and appended claims.

BRIEF DESCRIPTION OF THE DRAWINGS

FIG. 1 is a front view of a beverage dispenser of the present disclosure in a closed position.

FIG. 2 is a front perspective view of FIG. 1.

FIG. 3 is a rear perspective view of FIG. 1.

DETAILED DESCRIPTION OF THE DISCLOSURE

Figure 4:
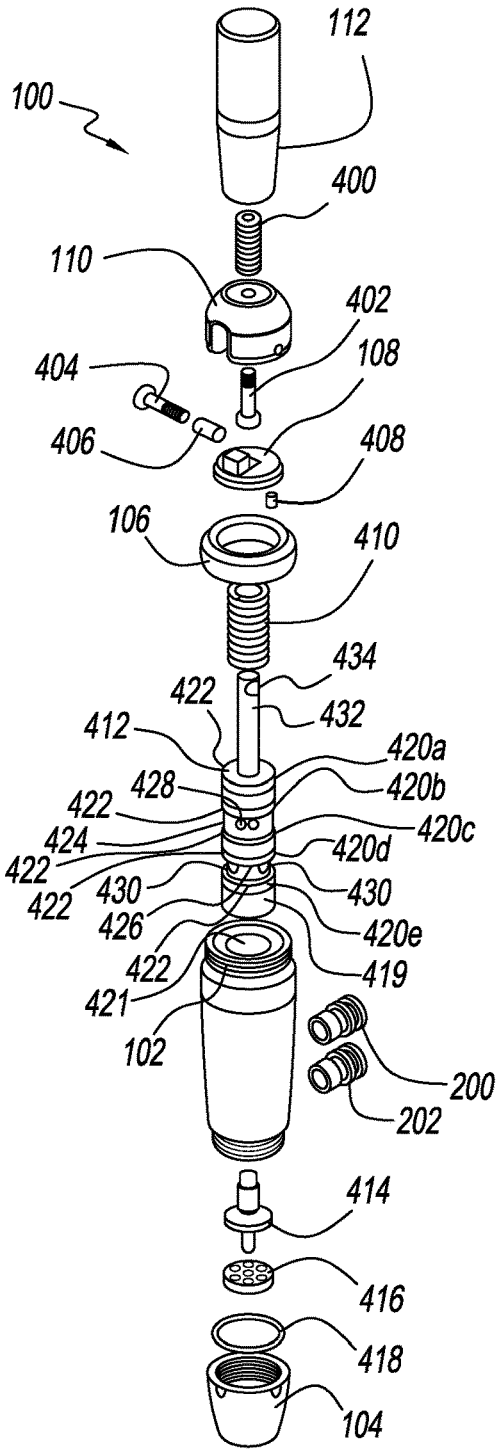
FIG. 4 is an exploded front perspective view of FIG. 1.

Referring to FIG. 1, beverage dispenser 100 of the present disclosure is shown. Beverage dispenser 100 is embodied as a tap, and when operating dispenses two different fluids and mixes them before a point of dispense. Typically a first fluid can be carbonated water, plain water, nitrogenized water, other gases infused water or syrups and a second fluid can be syrup, coffee or juices or dairy products. Additional fluids can be mixers, teas, flavors additives or enhancers. Alternatively, beverage dispenser 100 can dispense a single fluid. Beverage dispenser 100 has a dispenser housing 102. Dispenser housing 102 is connected to a nozzle 104 and a locking ring 106. Beverage dispenser 100 has a wear plate 108 inside locking ring 106 and a cam 110 on wear plate 108. Cam 110 is connected to handle 112.

Referring to FIG. 2, beverage dispenser 100 has a first inlet 200 and a second inlet 202 that each extend into dispenser housing 102. Each of first inlet 200 and second inlet 202 have an inlet plug 204 having o-ring seals 206. Cam 110 has hole 208. Alternatively, beverage dispenser 100 can have only one of first inlet 200 or second inlet 202 to dispense a single fluid, or beverage dispenser 100 can have one or more inlets in addition to first inlet 200 and second inlet 202 to dispense more than two fluids.

Referring to FIG. 3, first inlet 200 has a first opening 300 and second inlet 202 has a second opening 302. First opening 300 and second opening 302 are in fluid communication with an interior of dispenser housing 102. Cam 110 has hole 304.

Referring to FIG. 4, beverage dispenser 100 has a handle adaptor 400, a handle adaptor screw 402, a cam pin 404, a cam pin sleeve 406, a wear plate locking pin 408, a compression spring 410, a piston 412, a diffuser inlet 414, a diffuser element 416 and a nozzle seal 418. Piston 412 has a piston body 419. Piston body 419 has seals 420A, 420B, 420C, 420D, 420E and grooves 422 that are each sized to receive one of seals 420A, 420B, 420C, 420D, 420E by friction fit. Seals 420A, 420B, 420C, 420D, 420E are o-ring seals. Piston body 419 has a first depression 424 and a second depression 426. First depression 424 has holes 428. Second depression 426 has holes 430. Piston body 419 has a piston extension 432 having an opening 434.

Figure 5A:
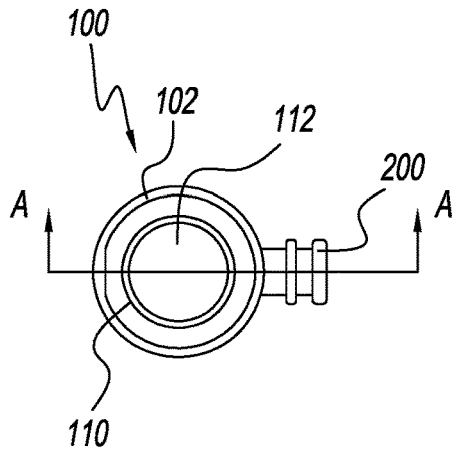
FIG. 5A is a top view of FIG. 1.
Figure 5B:
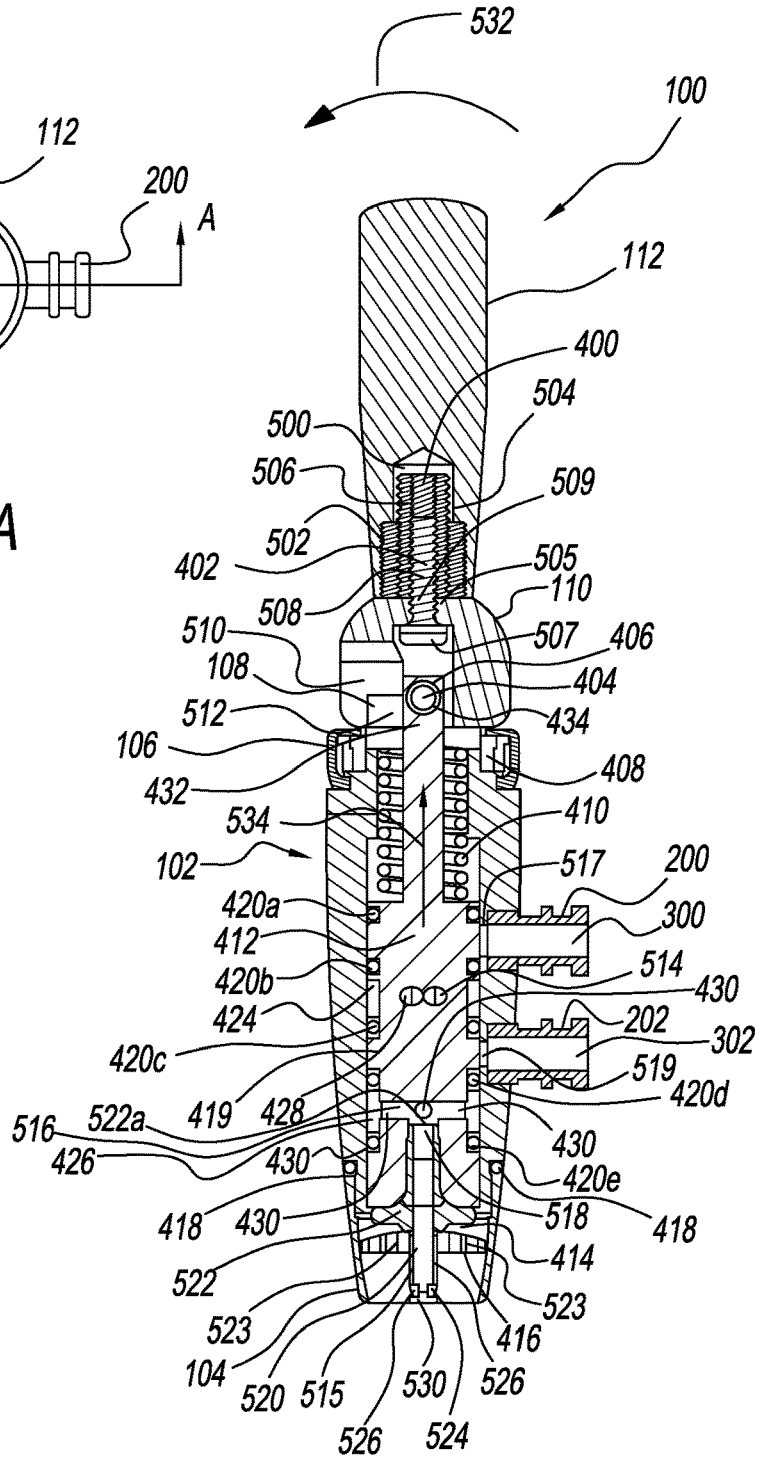
FIG. 5B is a side cross-sectional view taken along A-A of FIG. 5A.
Figure 7:
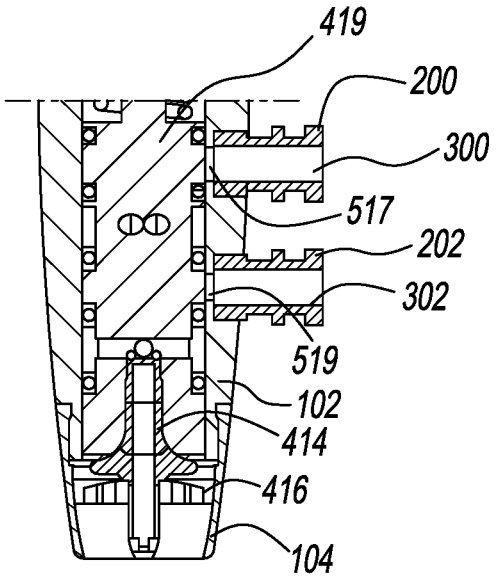
FIG. 7 is a partial side cross-sectional view taken along A-A of FIG. 5A.

Referring to FIGS. 5A, 5B and 7, handle 112 is connected to cam 110. Handle 112 has a cavity 500 having threads 502. Handle adaptor 400 has exterior threads 504 that engage threads 502 to connect handle 112 and handle adaptor 400. Cam 110 has an opening 505. Handle adaptor screw 402 has a handle head 507 and a handle body 509. Handle body 509 passes through opening 505 in cam 110. Handle adaptor 400 has interior threads 506 that engage threads 508 of handle adaptor screw 402 to secure cam 110 between handle head 507 of handle adaptor screw 402 on a first side and handle 112 and handle adaptor 400 on a second opposite side. Cam 110 is positioned on locking ring 106 and wear plate 108. Wear plate 108 extends through an opening in locking ring 106 such that a portion of wear plate 108 is in locking ring 106 and a portion of wear plate is outside of locking ring 106. Cam 110 has a cavity 510. Wear plate 108 has a protrusion 512 that extends into cavity 510 of cam 110. Locking ring 106 connects to dispenser housing 102, for example, by snap fit. Cam 110 is rotatable about cam pin 404. Cam 110 is rotatable on wear plate 108. Rotation of handle 112 in a direction 532 rotates cam 110.

Cam 110 is connected to piston 412. Piston extension 432 extends through dispenser housing 102, compression spring 410, locking ring 106, wear plate 108 and into cavity 510 of cam 110. Piston extension 432 of piston 412 is secured to cam 110 by cam pin 404 that passes through hole 208, cam pin sleeve 406 that is in opening 434 of piston extension 432 and into hole 304. Piston 412 is movable in a direction 534 in dispenser housing 102. Compression spring 410 biases piston 412 in a direction opposite direction 534 away from handle 112. Piston body 419 has a first chamber 514. Piston 412 has a second chamber 516 through piston body 419. Second chamber 516 has an inlet for fluid through holes 430 and an outlet 518 for fluid to exit second chamber 516. Alternatively, piston body 419 can have only first chamber 514 or only second chamber 516 to dispense a single fluid, or piston body 419 can additional chambers in addition to first chamber 514 and second chamber 516 to dispense more than two fluids.

Piston body 419 is in dispenser housing 102. Dispenser housing 102 has a first hole 517 and a second hole 519. First inlet 200 connects to dispenser housing 102, for example, by snap fit, so that first inlet 200 is in fluid communication with first hole 517. Second inlet 202 connects to dispenser housing 102, for example, by snap fit, so that second inlet 202 is in fluid communication with second hole 519. Dispenser housing 102 is connected to nozzle 104, for example, by snap fit. Dispenser housing 102 and nozzle 104 form a dispenser outlet 530.

In the closed position, seal 420A is on a first side of first inlet 200 and seal 420B is on a second side of first inlet 200 so that seals 420A, 420B and a surface of piston body 419 and a surface of dispenser housing 102 between seals 420A, 420B form a first plug sealing first opening 300 of first inlet 200 and first hole 517 of dispenser housing 102. In the closed position, seal 420C is on a first side of second inlet 202 and seal 420D is on a second side of second inlet 202 so that seals 420C, 420D and a surface of piston body 419 and a surface of dispenser housing 102 between seals 420C, 420D form a second plug sealing second opening 302 of second inlet 202 and second hole 519 of dispenser housing 102. Dispenser housing 102 has body chamber 421 in the middle to allow for vertical movement of piston 412 inside beverage dispenser 100 and mounts nozzle 104 in the bottom. Piston 412 is cylindrical in shape and consists of four sections: from a top section is the first plug for first inlet 200; second section is first chamber 514 for the first fluid, the third section is the second plug for the second fluid and the fourth section is second chamber 516 for the second fluid. Each section is sealed on both ends with o-rings of seals 420A, 420B, 420C, 420D, 420E as described herein.

Diffuser inlet 414 has a stem 515 that connects to piston body 419 inside of second chamber 516. Diffuser inlet 414 connects to piston body 419, for example, by snap fit. Diffuser inlet 414 forms a passage 520 in stem 515 that is in fluid communication with second chamber 516. Passage 520 has an inlet 522*a* and an outlet 524. Outlet 524 has four orifice holes 526 that each have a center axis angled at 45 degrees. Diffuser inlet 414 forms a disc 522 that extends outward from stem 515. Diffuser element 416 connects to stem 515 on a side of disc 522 opposite to piston 412. Diffuser inlet 414 connects to diffuser element 416, for example, by snap fit. Diffuser element 416 has holes 523 to control distribution of fluid through diffuser element 416.

Piston extension 432 of piston 412 is mechanically linked to cam 110 using cam pin 404 and cam pin sleeve 402. Cam 110 slides on wear plate 108 which acts as a bearing surface for cam 110. Wear plate 108 is arrested in place using wear plate locating pin 408 located on dispenser housing 102 and locking ring 106. Piston 412 also has compression spring 410 to help return piston 412 back to a return position and proper sealing when in the closed position. Cam 110 also holds handle 112 on using a threaded handle adaptor 402 that may be changed to different sizes to allow flexibility of changing the handles with different logos.

Figure 6A:
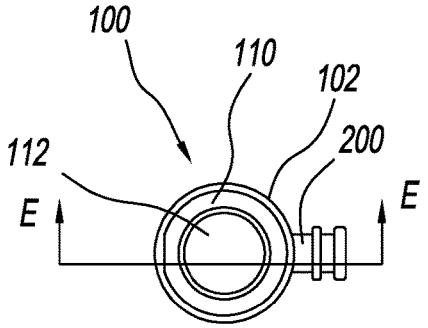
FIG. 6A is a top view of FIG. 1.
Figure 6B:
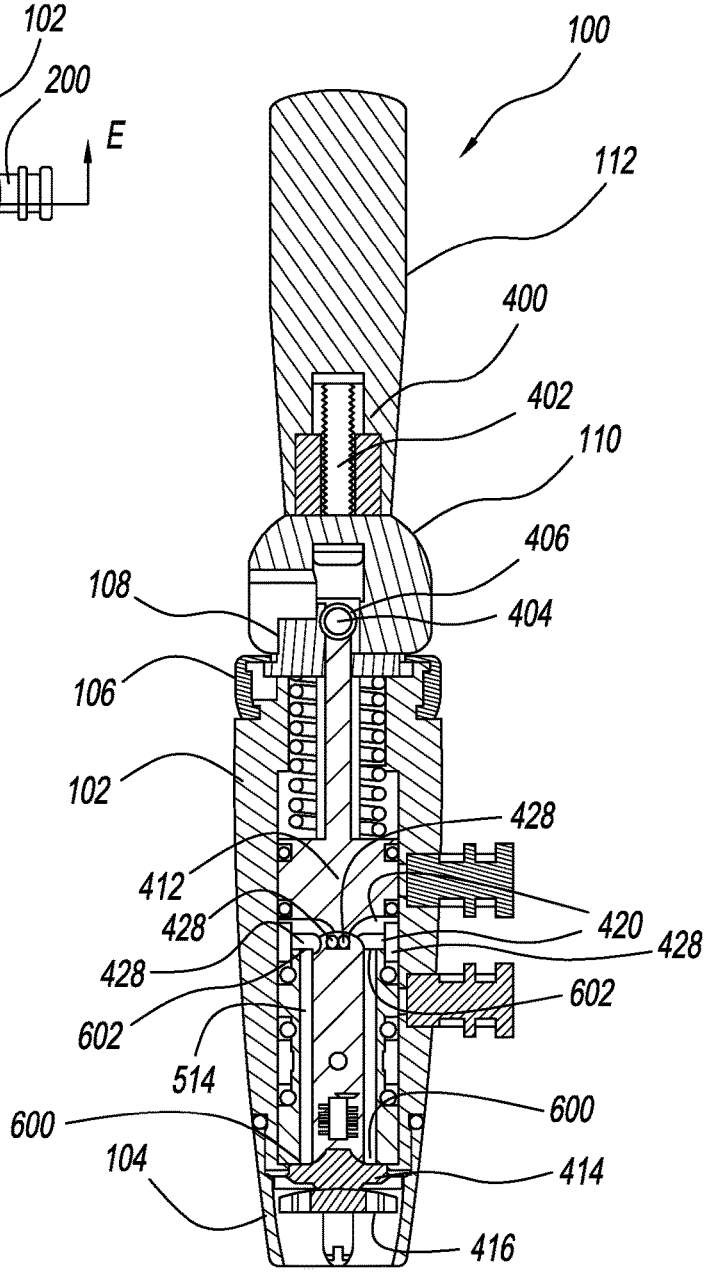
FIG. 6B is a side cross-sectional view taken along E-E of FIG. 6A.

Referring to FIGS. 6A and 6B, first chamber 514 has an inlet for fluid through holes 428 and an outlet 600 for fluid to exit second chamber 514. Holes 428 can be eight holes, so that the first fluid entering holes 428 is placed perpendicular to orifices 602 of first chamber 514. The first fluid is directed to be dispensed from first chamber 514 between piston 412 and diffuser inlet 414. Each of holes 428 can have a separate first chamber 514 that each have one of outlets 600, or first chamber 514 can be common to one or more of holes 428.

The closed position of beverage dispenser 100 is shown in FIGS. 1-3, 5A-7. Referring back to FIG. 5B, seal 420A being on the first side of first inlet 200 and seal 420B being on the second side of first inlet 200 so that seals 420A, 420B and the surface of piston body 419 and the surface of dispenser housing 102 between seals 420A, 420B form the plug sealing first opening 300 of first inlet 200 and first hole 517 of dispenser housing 102 blocks first inlet 200 from fluid communication with first chamber 514. Seal 420C being on the first side of second inlet 202 and seal 420D being on the second side of second inlet 202 so that seals 420C, 420D and the surface of piston body 419 and the surface of dispenser housing 102 between seals 420C, 420D form the plug sealing second opening 302 of second inlet 202 and second hole 519 of dispenser housing 102 blocks second inlet 202 from fluid communication with second chamber 516. Accordingly, in the closed position, handle 112 maintains piston 412 in a position to seal first hole 517 and second hole 519 and/or first inlet 200 and second inlet 202 to block flow of the first fluid and the second fluid out of dispenser outlet 530.

Figure 8:
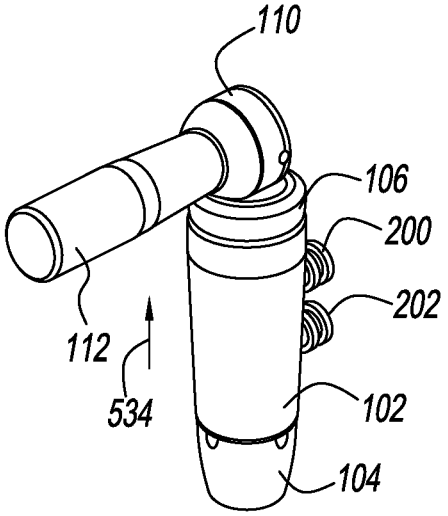
FIG. 8 is an front perspective view of the beverage dispenser of FIG. 1 in a open position.
Figure 9:
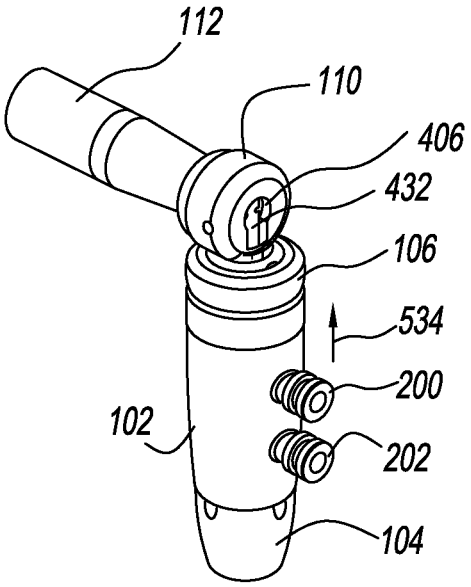
FIG. 9 is a rear perspective view of FIG. 8.
Figure 10A:
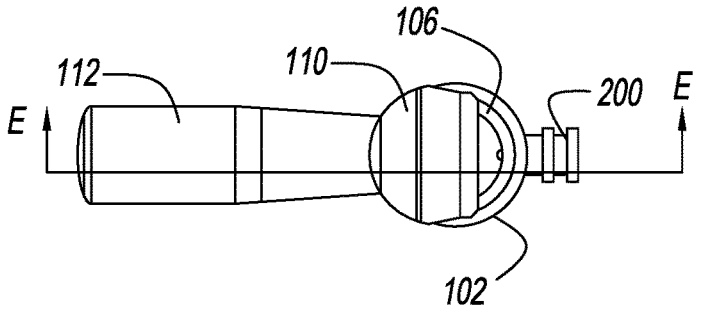
FIG. 10A is a top view of FIG. 8.
Figure 10B:
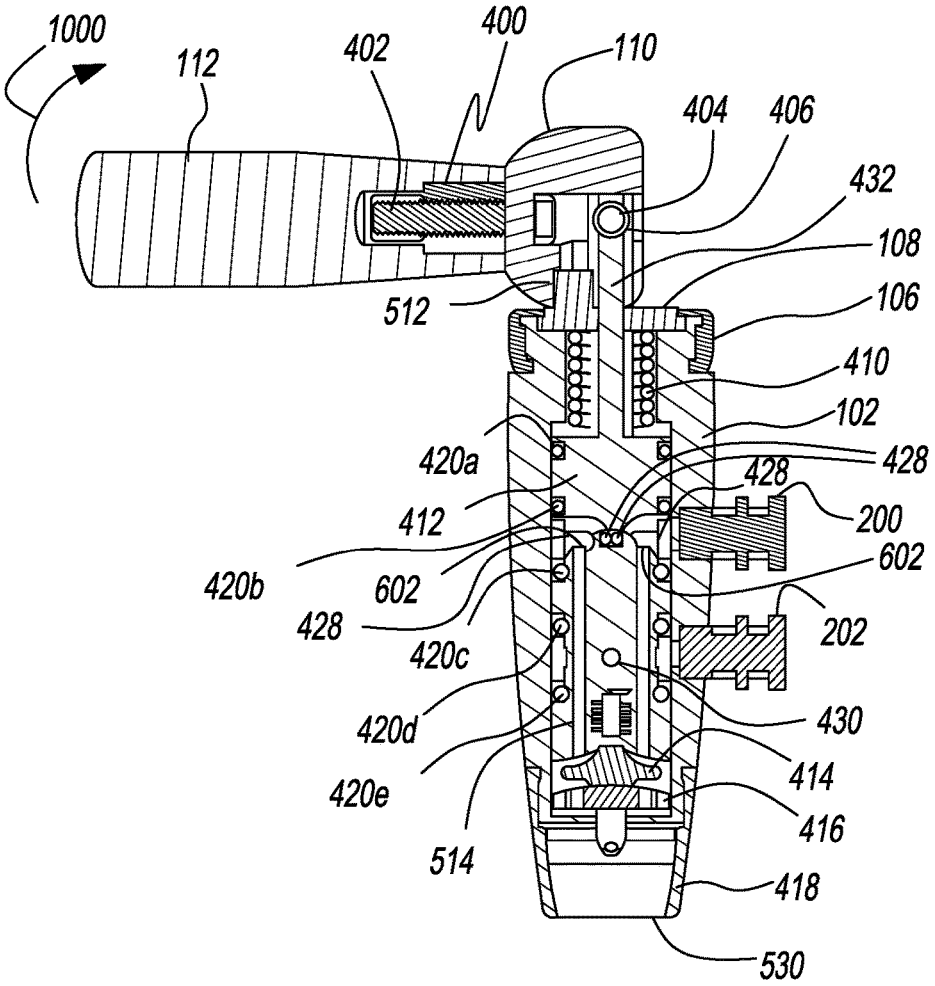
FIG. 10B is a side cross-sectional view taken along E-E of FIG. 10A.
Figure 11A:
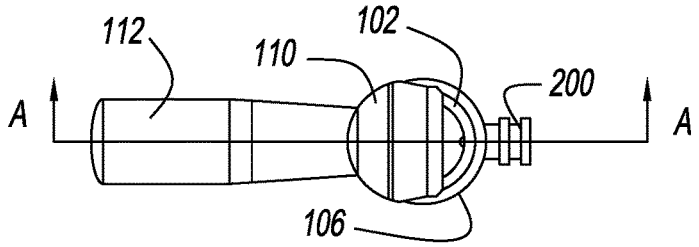
FIG. 11A is a top view of FIG. 8.
Figure 11B:
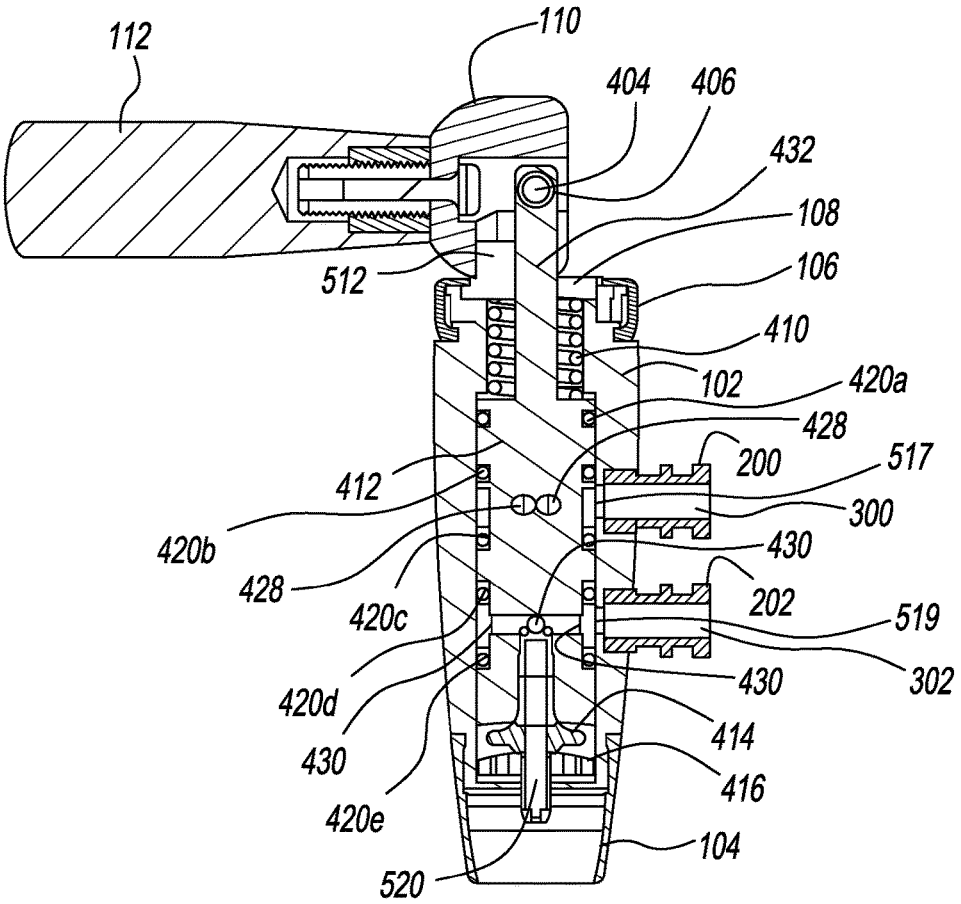
FIG. 11B is a side cross-sectional view taken along A-A of FIG. 11A.

A force is applied to handle 112 to rotate of handle 112 and cam 110 in direction 532 moves dispenser 100 from the closed position shown in FIGS. 1-3, 5A-7 to an open position shown in FIGS. 8 and 9. Rotation of handle 112 and cam 110 from the closed position to the open position moves piston 412 linearly in direction 534 by cam 110 rotating on wear plate 108 to move cam pin 404 away from dispenser housing 102 that also moves piston extension 432 in direction 534. A shape of cam 110 and wear plate 108 direct rotation and a distance that piston 412 is moved in direction 534. Wear plate 108 has protrusion 512 that extends into cavity 510 of cam 110 to direct rotation of cam 110. When handle 112 is pulled in direction 532 the orientation of cam 110 changes thereby translating rotary motion into linear motion and exposing first inlet 200 to first chamber 514 and second inlet 202 to second chamber 516.

Referring to FIGS. 10A-11B, in the open position, seal 420B is on the first side of first inlet 200 and seal 420C is on the second side of first inlet 200 so that holes 428 are placed in fluid communication with first opening 300 of first inlet 200 and first hole 517 of dispenser housing 102. In the open position, seal 420D is on the first side of second inlet 202 and seal 420E is on a second side of second inlet 202 so that holes 430 are in fluid communication with second opening 302 of second inlet 202 and second hole 519 of dispenser housing 102.

Figure 13:
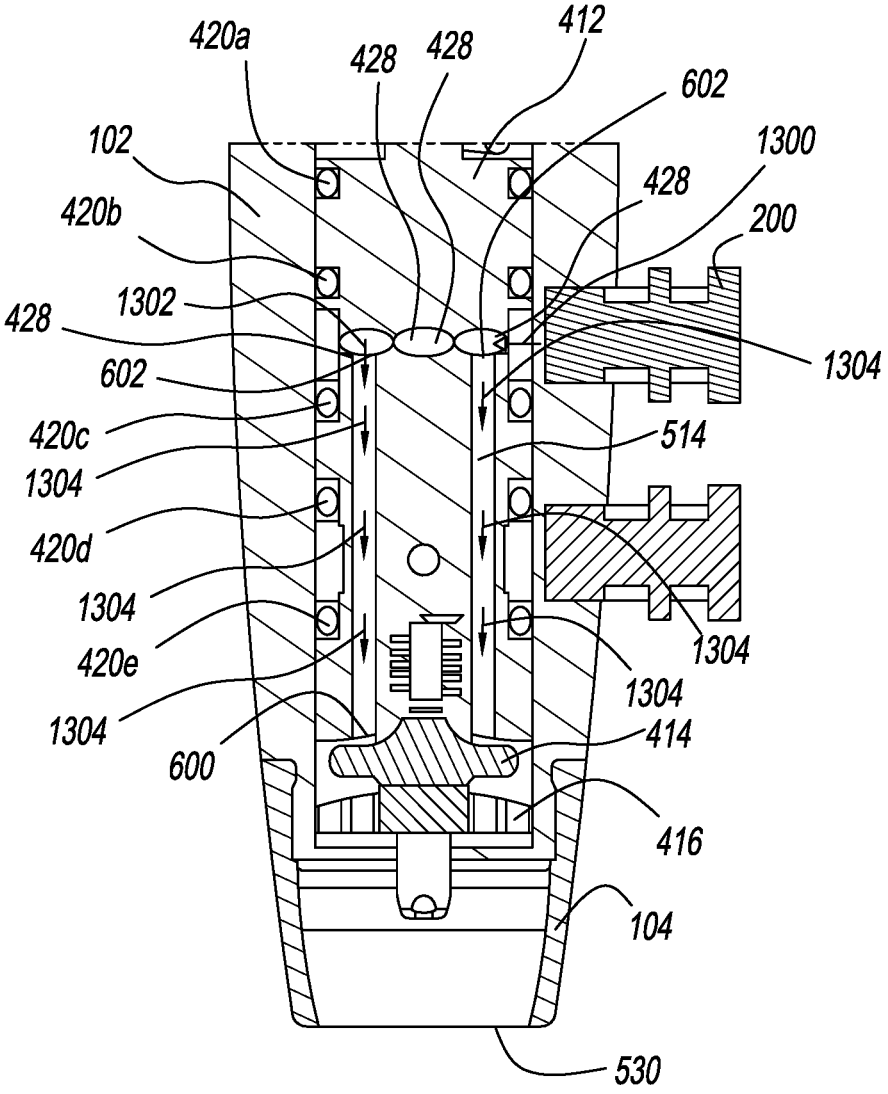
FIG. 13 is a partial side cross-sectional view taken along E-E of FIG. 10A showing the flow of the first fluid.

Referring to FIG. 13, in operation when beverage dispenser 100 is in the open position, a first fluid source to provide a flow of the first fluid is connected to first inlet 200. The first fluid flows into first opening 300 of first inlet 200 and first hole 517 of dispenser housing 102 as shown by arrow 1300. The first fluid flows from first hole 517 into dispenser housing 102 and through holes 428 into piston 412 as shown by arrow 1302 and orifice 602 into first chamber 514 in piston 412 that is perpendicular to holes 428. The first fluid flows through first chamber 514 toward outlet 600 as shown by arrows 1304. A number of holes 428 and a size of orifices holes 602 can be varied to achieve different characteristics from different types of the beverages. For example, smaller orifice size for nitrogen infused beverages will provide more creamy texture; slightly larger orifice size provides more gas retention for Co2 infused beverages.

Figure 12:
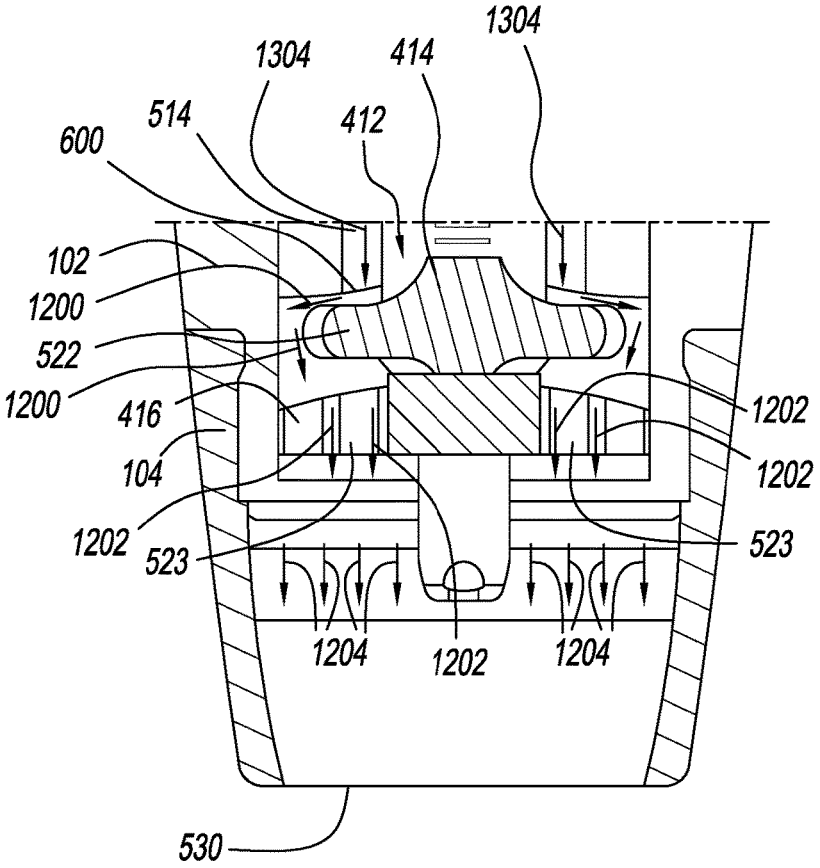
FIG. 12 is a partial side cross-sectional view taken along E-E of FIG. 10A showing a flow of a first fluid.

Referring to FIG. 12, the first fluid flows from first chamber 514 out of outlet 600 into dispenser housing 102 around disc 522 of diffuser inlet 414 as shown by arrows 1200 and through holes 523 of diffuser element 416 as shown by arrows 1202. The first fluid flows from diffuser element 416 toward dispenser outlet 530 as shown by arrows 1204. A distance between outlet 600 and disc 522 is critical to retain and desired pressure and flow characteristics of the first fluid. This distance between outlet 600 and disc 522 can be modified depending on different types of the first fluid.

Figure 14:
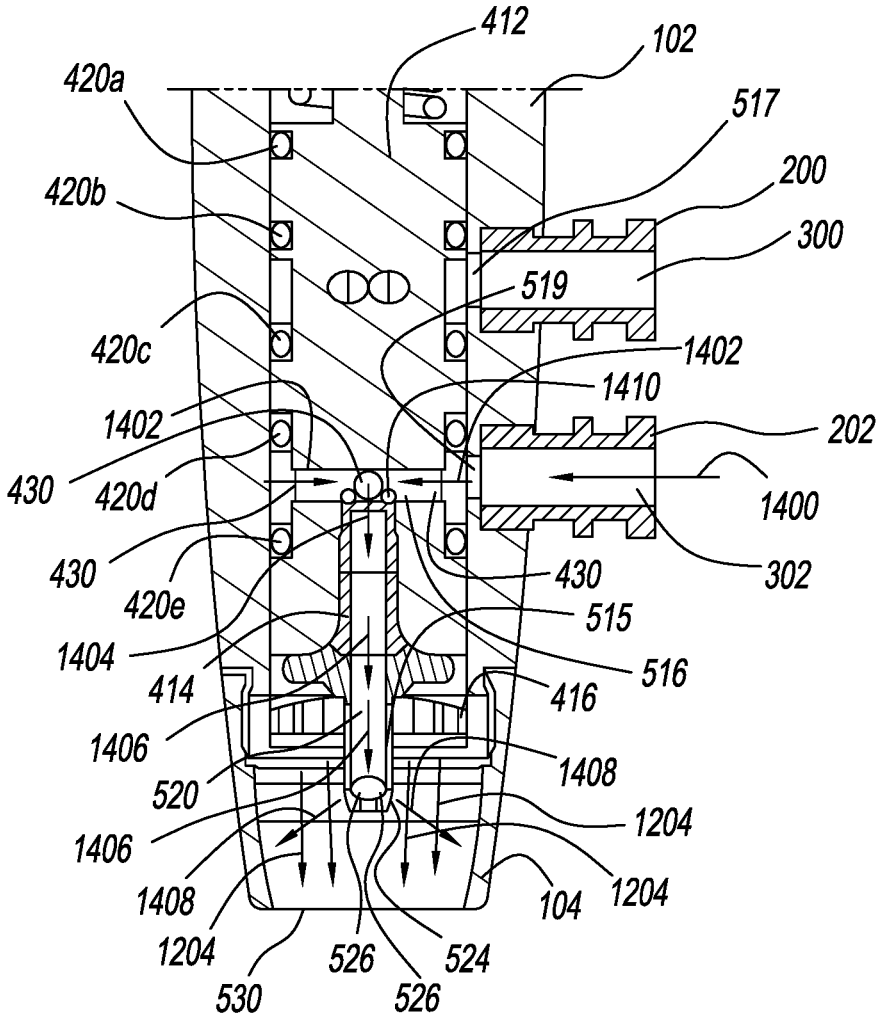
FIG. 14 is a partial side cross-sectional view taken along A-A of FIG. 11A showing a flow of a second fluid.

Referring to FIG. 14, in operation when beverage dispenser 100 is in the open position, a second fluid source to provide a flow of the second fluid is connected to second inlet 202. The second fluid flows into second opening 302 of second inlet 202 and second hole 519 of dispenser housing 102 as shown by arrow 1400. The second fluid flows from second hole 519 into dispenser housing 102 and through holes 430 into piston 412 as shown by arrows 1402 into second chamber 516 in piston 412. The second fluid flows through second chamber 516 into passage 520 of diffuser inlet 414 as shown by arrow 1404. The second fluid flows through passage 520 of diffuser inlet 414 toward orifice holes 526 of outlet 524 as shown by arrows 1406. The second fluid flows through orifice holes 526 from passage 520 as shown by arrows 1408 and sprayed into the first fluid as shown by arrows 1204 mixing the first fluid and the second fluid prior to exiting beverage dispenser 100 through dispenser outlet 530. Accordingly, the second fluid from second inlet 302 enters second chamber 516 through four holes that allow the second fluid to be dispensed from a center on piston 412 through diffuser inlet 414.

A diffuser assembly has three sections, disc 522 of diffuser inlet 414, diffuser element 416 and stem 515 of diffuser inlet 414. The disc 522 is located underneath outlet 600 for the first fluid from piston 412. Disc 522 has radial and angular geometric features to allow the first fluid to cascade without creating turbulence in the first fluid. The first fluid then cascades onto diffuser element 416, which has holes 523, shown as several small holes, that allows the first fluid to be equally distributed in the pour during dispense from of nozzle 104 and proper mixing with the second fluid. Stem 515 has a thru hole for outlet 524 with orifice holes 526 on the bottom angled at 45 degrees. This allows the second fluid to be sprayed as small particles in to the stream of the first fluid right before being dispensed out of beverage dispenser 100. This allows for good mixing of the second fluid in the first fluid's flow path and proper stratification of the final dispensed product. The number of orifice holes 526, size of orifice holes 526 and angles of orifice holes 526 can be varied in stem 515 for different beverages (syrup vs juice vs coffee or any type of mixed beverages including alcohol) to achieve different characteristics and to accommodate for different particle sizes in the first fluid and/or the second. Particles are, for example, pulp in orange juice, that can become jammed or clogged in orifice holes 526. This allows the tap to dispense fluids and mixing them right before dispensing from the tap outlet when dispensing more than one fluid. This avoids the excess loss of carbonation and foaming which will occur when premixing the beverages in traditional taps/faucets. Piston 412 is mounted with a diffuser assembly, diffuser inlet 414 and diffuser element 416, and dispenser housing 102 with a nozzle 104. Both the diffuser assembly and nozzle 104 help the dispense beverage performance and flow characteristics during dispense state in operation of the open position. Nozzle seal 418 and seal 1410 of the diffuser assembly are o-rings are used for sealing both the components to their respective assemblies. Seal 1410 is between diffuser inlet 414 and piston 412 inside second chamber 516.

Referring back to FIG. 10B, during operation, after dispense of the desired amount of the first fluid and the second fluid, handle 112 and cam 110 can be rotated in direction 1000 to return beverage dispenser 100 back to the closed position shown in FIGS. 1-3, 5A-7. Compression spring 410 exerts a force on piston 412 so that a lower force is need to be applied to handle 112 to rotate handle in direction 1000 from the open position to the closed position. Alternatively, one or more seals, for example, seals 420A, 420B, 420C, 420D, 420E, can be positioned on piston 412 so that handle 112 can be configured to rotate to different positions, for example, by rotation forward and/or backward and/or to the left side and/or to the right side, moving piston 412 in dispenser housing 102 between one or more open positions and one or more closed positions where motion of piston 412 is variable in direction and distance in each of the one or more open positions and the one or more closed positions to allow or block fluid communication between first inlet 200, second inlet 202 and one or more inlets to first chamber 514, second chamber 516, and one or more additional chambers, respectively, in different combinations allowing dispense of the first fluid, the second fluid and the one or more additional fluids in different combinations for each of the one or more open positions and the one or more closed positions.

Beverage dispenser 100 will provide distinctive look and still provide a good performance beverage and a more premium user experience. Dispenser housing 102 is cylindrical in shape with first inlet 200 and second inlet 202 located on a back side. The external tap profile of beverage dispenser 100 can be in several different shapes based on customer requirements. Beverage dispenser 100 is more compact than beverage dispenser blocks typically in service and used directly by the consumer. First inlet 200 on the top dispenses the first fluid and second inlet 202 in the bottom dispenses the second fluid. First inlet 200 and second inlet 202 can be reversed as well, so that first inlet 200 on the top dispenses the second fluid and second inlet 202 on the bottom dispense the first fluid; however, dimensions of beverage dispenser 100 may need to be modified accordingly.

Figure 15:
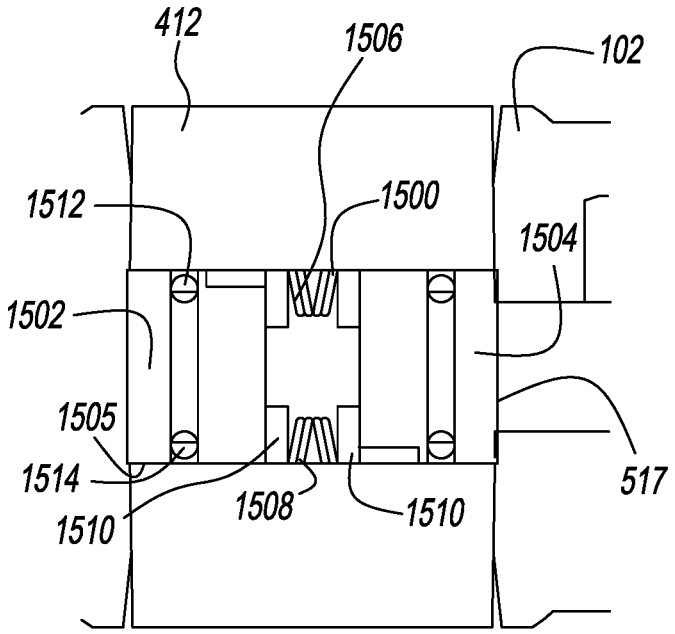
FIG. 15 is a side cross-sectional view of the beverage dispenser of FIG. 1 having a pressure pad instead of seals.
Figure 16:
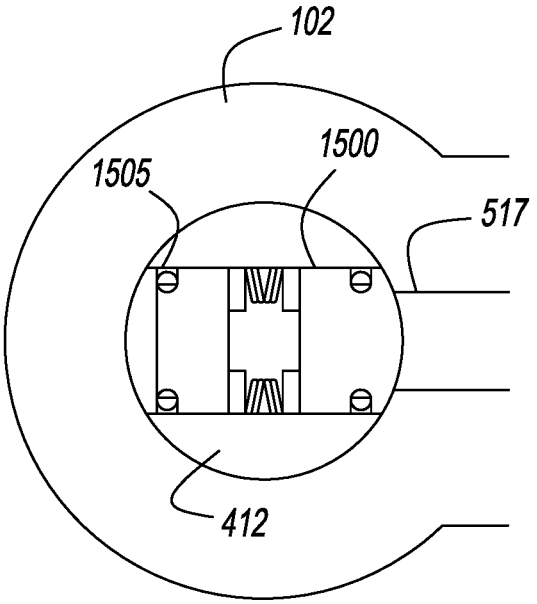
FIG. 16 is a cross-sectional view of FIG. 15.
Figure 17:
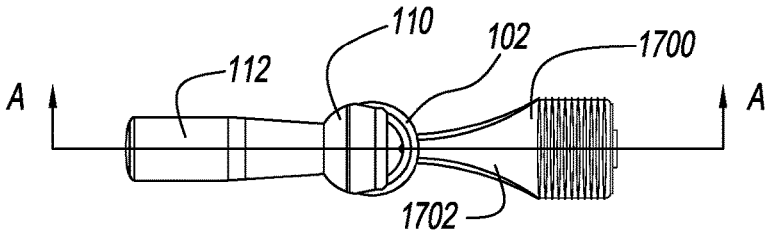
FIG. 17 is a top view of the beverage dispenser of FIG. 8 having an adapter instead of inlets.
Figure 18:
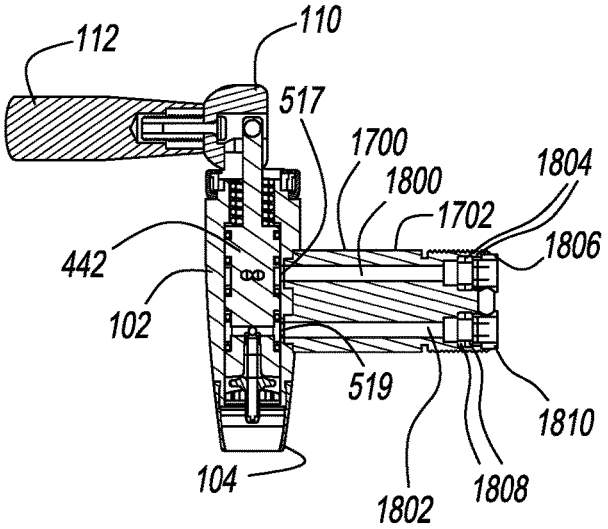
FIG. 18 is a side cross-sectional view taken along A-A of FIG. 17.
Figure 19:
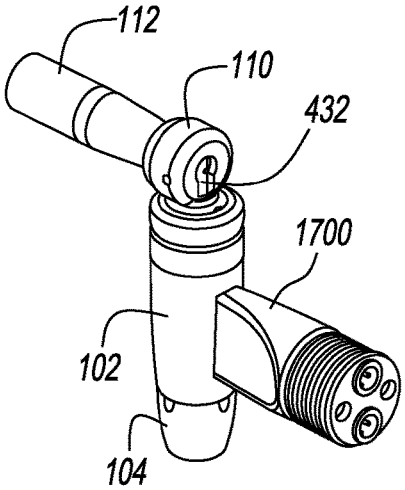
FIG. 19 is a rear perspective view of FIG. 17.
Figure 20:
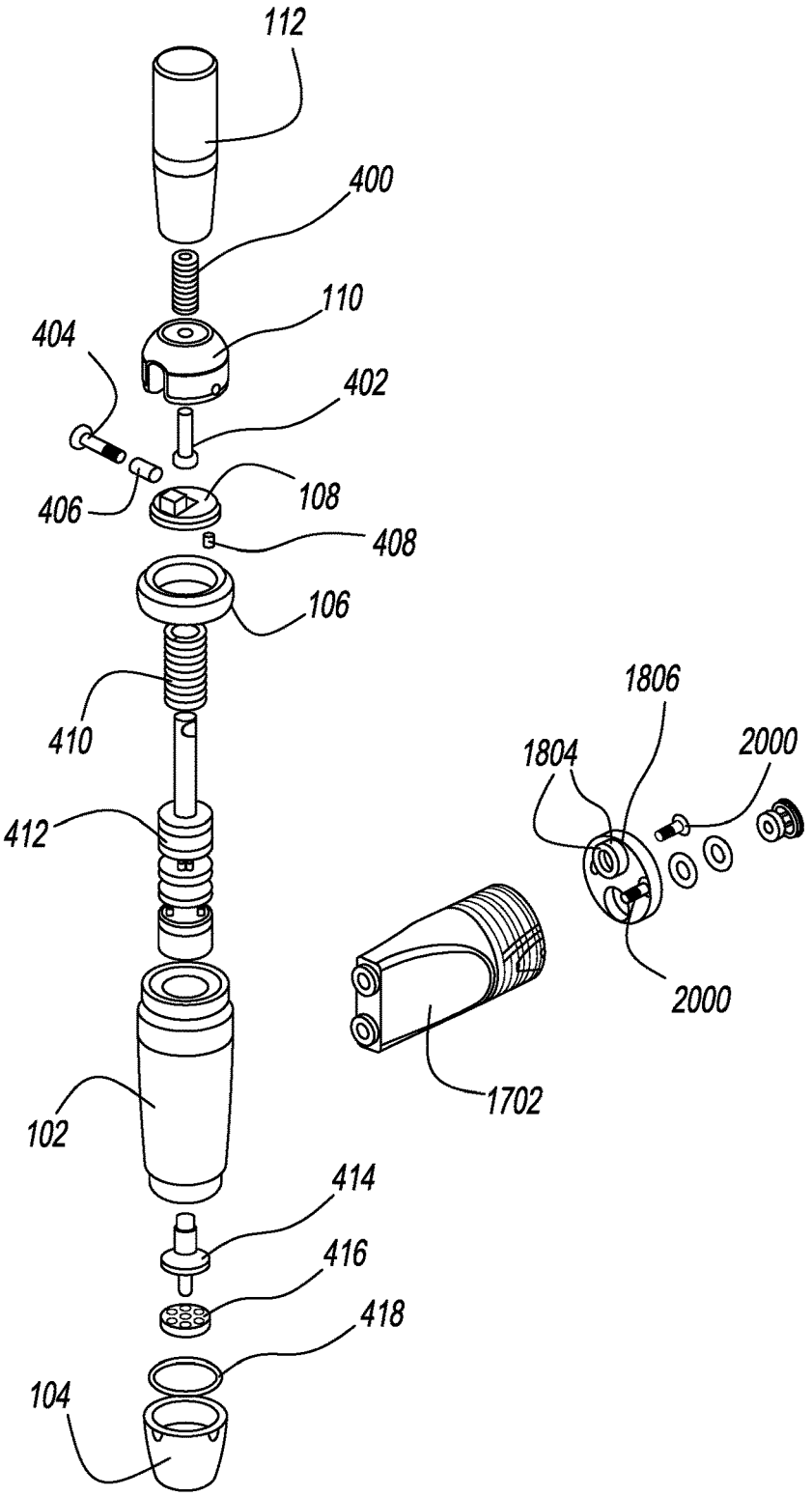
FIG. 20 is an exploded front perspective view of FIG. 17.

Referring to FIGS. 15-16, the first plug including seals 420A, 420B and the second inlet plug including seals 420C, 420D can be replaced with pressure pad assemblies 1500. Two pressure pads 1502, 1504 are assembled into a bore 1505 through piston 412 with two wave springs 1506, 1508 in between them. Each of wave springs 1506, 1508 has a washer 1510 on opposite sides. Each of pressure pads 1502, 1504 has two o-rings 1512, 1514 therein that are not exposed to piston 412 or dispenser housing 102. Pressure pad assemblies 1500 maintain constant pressure and eliminate the need of changing O-ring seals. First chamber 514 and second chamber 516 will both remain the same. Seals 420A, 420B, 420C, 420D that are o-rings require replacement about every six months to one year, whereas, pressure pad assemblies 1500 have a significantly longer lifespan than o-rings.

Figure 21:
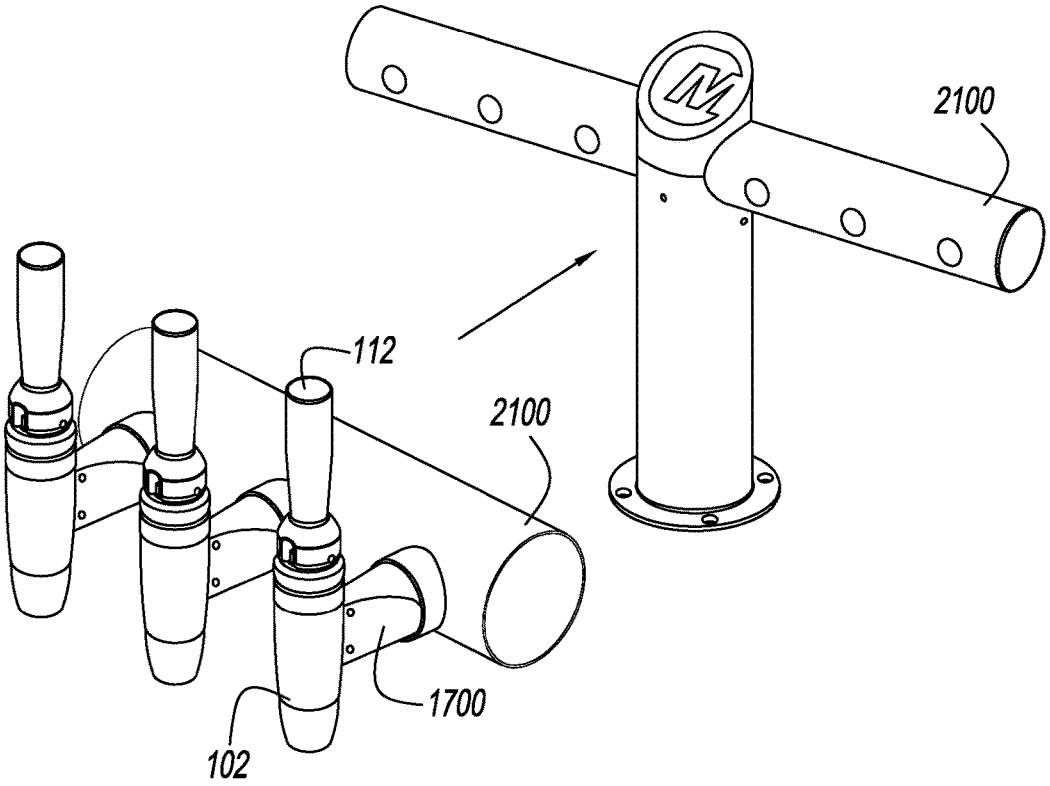
FIG. 21 is a front perspective view of the beverage dispenser of FIG. 17 connected to a font mount.

Referring to FIGS. 17-20, first inlet 200 and second inlet 202 can be replaced with other features such as push to connect fittings or barb fittings to allow connecting to the tap in different applications. First inlet 200 and second inlet 202 can be replaced by a tap adaptor 1700. Tap adaptor 1700 has a tap adaptor housing 1702. Tap adaptor 1700 has a first conduit 1800 and a second conduit 1802 in tap adaptor housing 1702. First conduit 1800 is in fluid communication with first hole 517 in dispenser housing 102. Second conduit 1802 is in fluid communication with second hole 519 in dispenser housing 102. Tap adaptor housing 1702 has first o-rings 1804 and a collar 1806 in first conduit 1800. Tap adaptor housing 1702 has second o-rings 1808 and a collar 1810 in second conduit 1802. Tap adaptor 1700 can be connected to a tower mount 2100 as shown in FIG. 21, for example, a font, by screws 2000. First conduit 1800 and second conduit 1802 can be sized according to pressure of the first fluid and the second fluid supplied by tower mount 2100. First inlet 200 and second inlet 202 can be changed and adaptor pieces can be added to be able to mount on different types of units such tower mount, font mount and counter top units.

Figure 22:
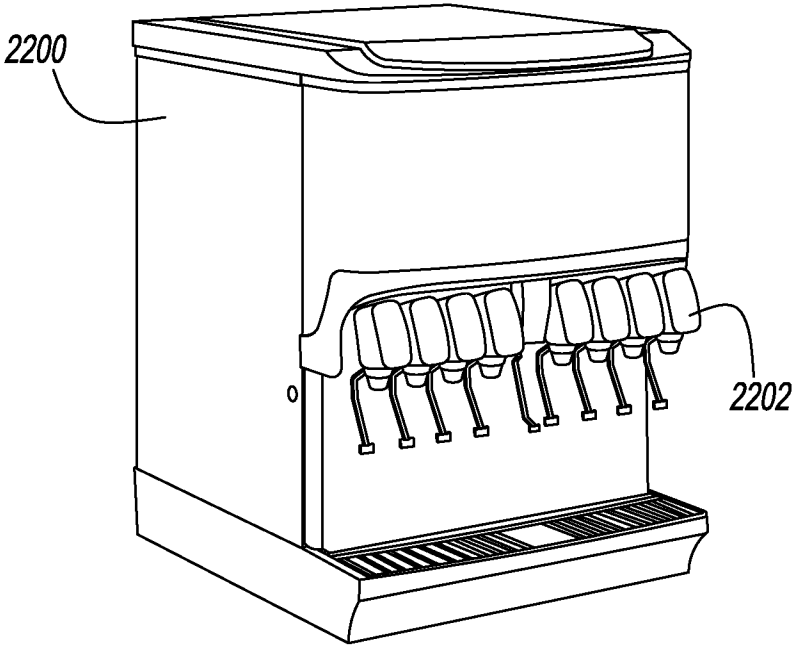
FIG. 22 is a front perspective view of the beverage dispenser of FIG. 1 connected to a counter top unit.
Figure 22:
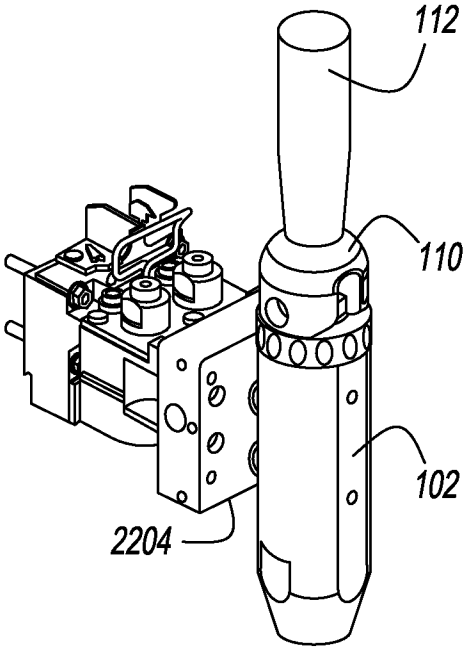

Referring to FIG. 22, adaptors will also allow us to be able to retrofit the current discrete valves in the field with the new tap. Beverage dispensers 2202 in counter top units 2200 receive the first fluid and the second fluid in a vertical direction. Counter top adaptor 2204 includes conduits that direct vertical flow of the first fluid and the second fluid into horizontal flow to be received by first hole 517 and second hole 519 in dispenser housing 102 to connect with counter top units 2200.

Figure 23:
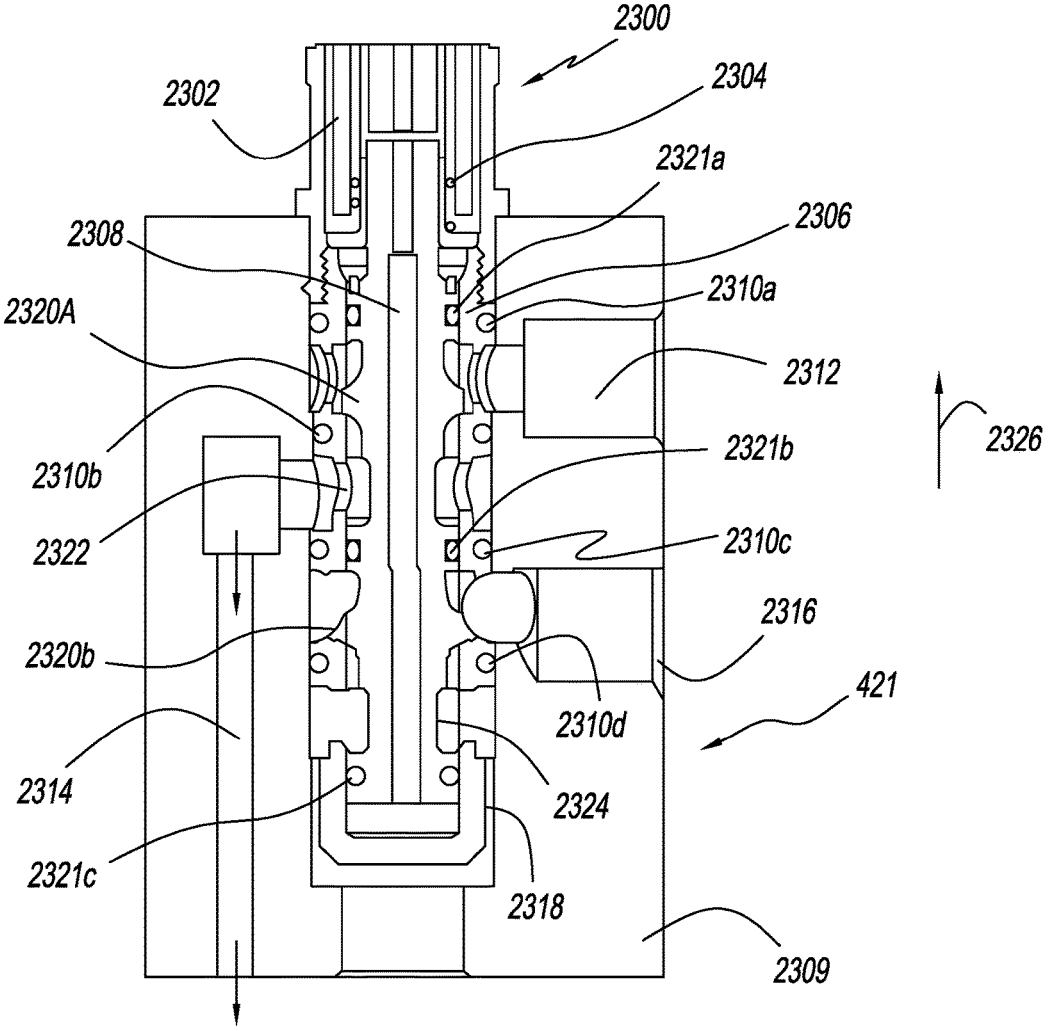
FIG. 23 is a side cross-sectional view of a modified beverage dispenser of FIG. 1 having a solenoid of the present disclosure in a closed position.
Figure 24:
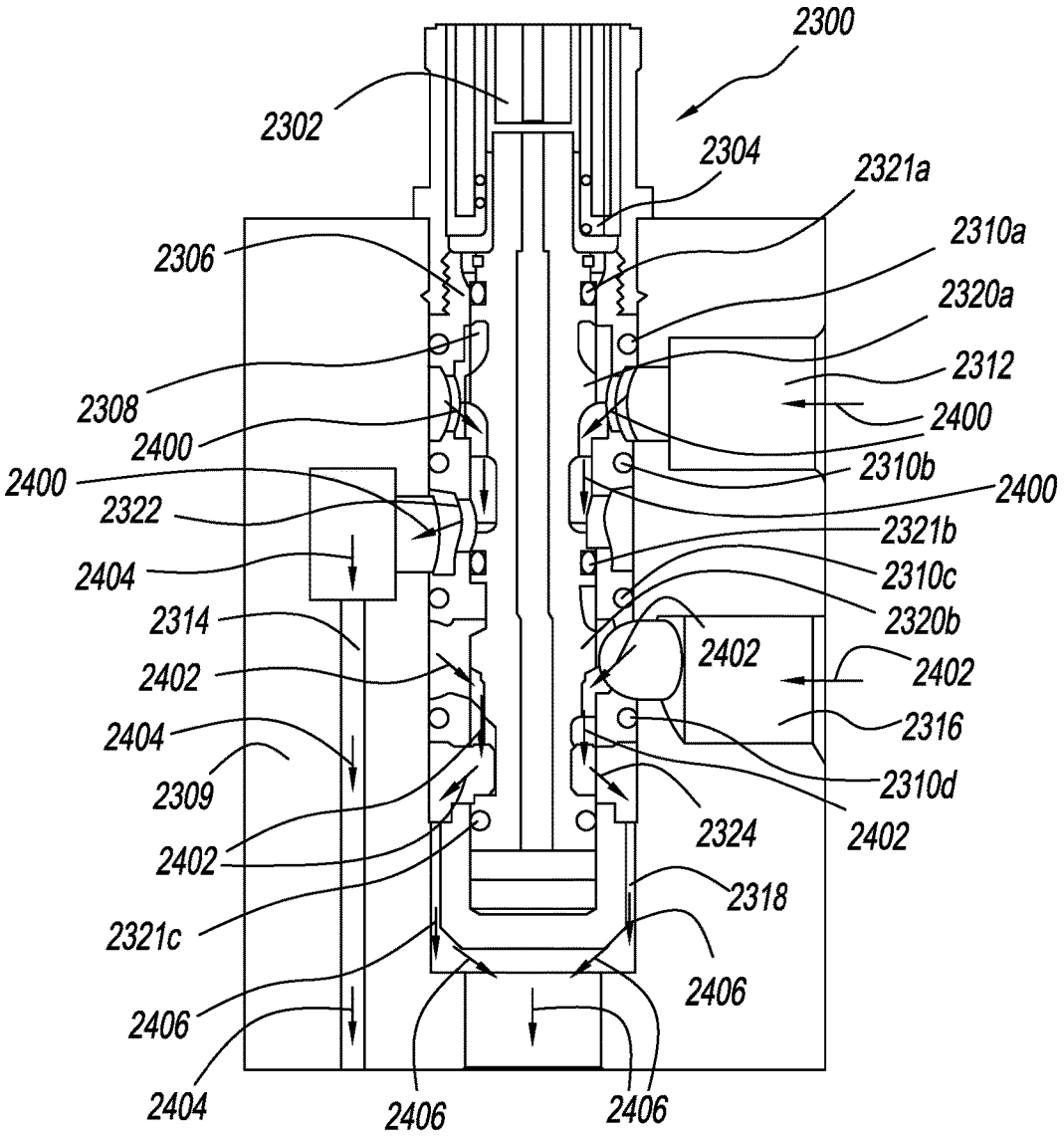
FIG. 24 is a side cross-sectional view of the modified beverage dispenser of FIG. 23 in an open position.
Figure 26:
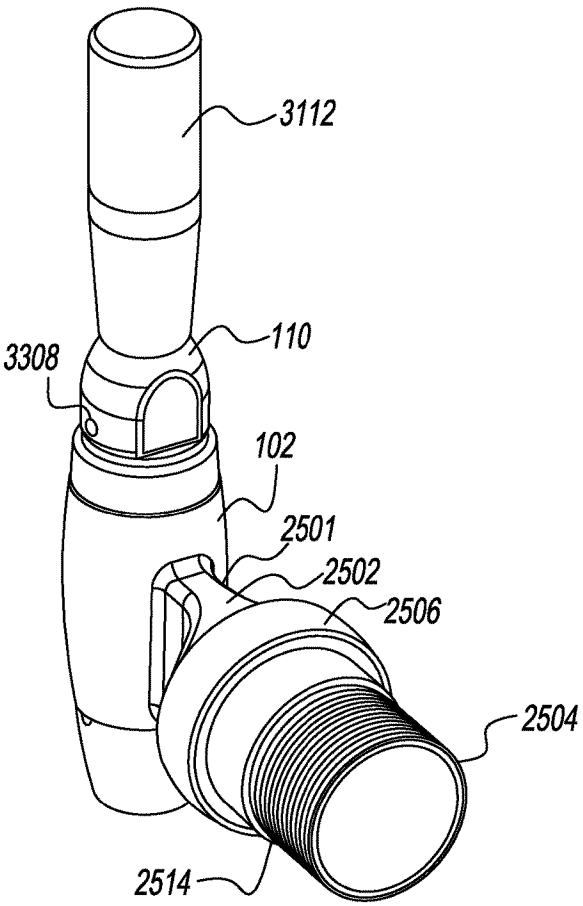
FIG. 26 is a top rear perspective view of the beverage dispenser of FIG. 25 in the closed position.

Referring to FIGS. 23-24, a beverage dispenser 2300 is shown of the present disclosure that is a modified beverage dispenser from beverage dispenser 100 of FIG. 1. Components of beverage dispenser 2300 that are the same as beverage dispenser 100 are referenced using the same reference numerals herein. Beverage dispenser 2300 has an electronically controlled actuator. The electronically controlled actuator can be a solenoid assembly 2302. Solenoid assembly 2302 replaces internal components so that external components such as handle 112 and cam 110 can remain. Beverage dispenser 2300 does not include piston 412 or spring 410 and instead has solenoid assembly 2302 inside a dispenser housing 102. Some designs may or may not have cam 110 based on the customer design requirement. Cam 110 can be included as a cosmetic part and will allow the overall aesthetics to be same as beverage dispenser 100. Referring to FIG. 23, solenoid assembly 2302 has a coil 2304, an outer casing 2306 and stem 2308 inside solenoid casing 2309 that is in dispenser housing 102. Outer casing 2306 has O-rings 2310A, 2310B to seal first solenoid housing inlet 2312 and first dispense chamber 2314 for the first fluid. Outer casing 2306 has O-rings 2310C, 2310D to seal solenoid housing inlet 2316 and second dispense chamber 2318 for the second fluid. Stem 2308 is located in the center of outer casing 2306. Stem 2308 has rubber seal 2320A. Rubber seal 2320A blocks flow of the first fluid from first solenoid housing inlet 2312 into first dispense chamber 2314 through first channel inlet 2322 when in the closed position. O-ring 2321A blocks flow for the first fluid into solenoid assembly 2302. Stem 2308 has rubber seal 2320B. Rubber seal 2320B and o-ring 2321B block flow of the second fluid from second solenoid housing inlet 2316 into second dispense chamber 2318 through second channel inlet 2324 when in the closed position. When coil 2304 in solenoid assembly 2302 is energized, stem 2308 moves vertically in direction 2326 to move rubber seals 2320A, 2320B to open a first passage from first solenoid housing inlet 2312 to first channel inlet 2322, as shown by arrows 2400 in FIG. 24, and to open a second passage from solenoid housing inlet 2316 to second channel inlet 2324, as shown by arrows 2402 in FIG. 24. The flow of the first fluid is maintained in the first passage, as shown by arrows 2404, by rubber seal 2320A, o-ring 2321A and o-ring 2321B. The flow of the second fluid is maintained in the second passage, as shown by arrows 2406, by rubber seal 2320B, o-ring 2321B and o-ring 2321C. Once the first fluid exits first dispense chamber 2314 and the second fluid exits first dispense chamber 2318, beverage dispenser 2300 has the same configuration as beverage dispenser 100 with diffuser inlet 414, diffuser element 416, nozzle seal 418 and nozzle 104. When solenoid assembly 2302 is deenergized, stem 2308 moves vertically in a direction opposite to direction 2326 to the closed position as shown in FIG. 23. Solenoid assembly 2302 can be energized using a micro switch located inside beverage dispenser 2300 and in some cases an external micro switch which is connected in parallel for remote access from beverage dispenser 2300. Remote access feature allows the tap design to be Americans with Disabilities Act ("ADA") complaint regardless of a mounting height of beverage dispenser 2300.

Ratio and flow rate adjustments for the first fluid and the second fluid can be done using several methods. One such method places an in line needle valve or flow controls, either remotely or inside the font/tower on which beverage dispenser 100, 2300 is mounted. Another method uses pulsing solenoid assembly 2302 inside the tap: oscillating/pulsing stem 2308 at a frequency to allow both the first fluid and the second fluid to dispense at the same time. The frequency of the solenoid oscillation can be varied and adjusted for different flow rates. Another method uses volumetric based pumps such as peristaltic pumps installed inline that allows for consistent dispensing of correct ratios of the first fluid and the second fluid when solenoid assembly 2302 and switch are used inside beverage dispense 2300.

Figure 25:
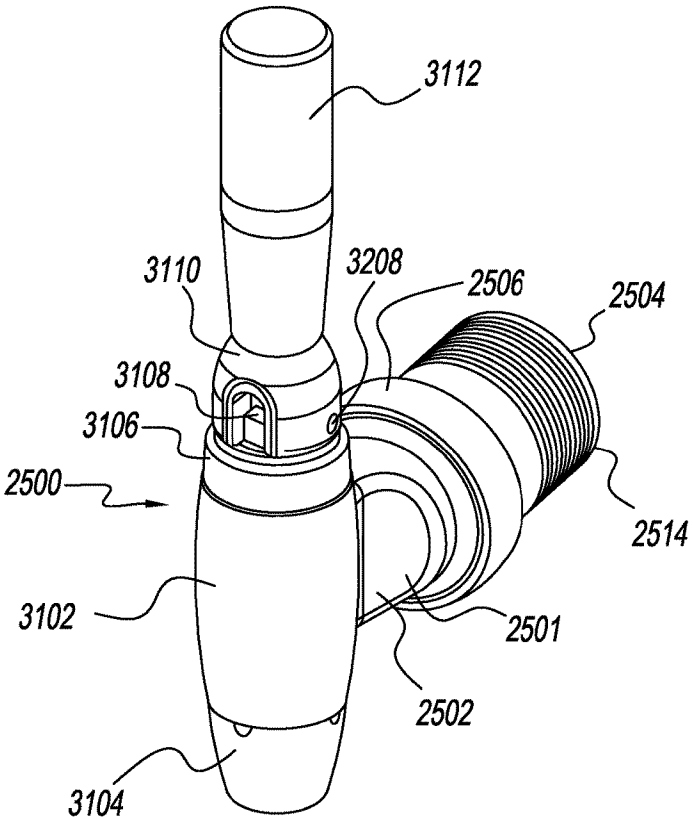
FIG. 25 is a top front perspective view of another embodiment of a beverage dispenser of the present disclosure in a closed position.
Figure 30:
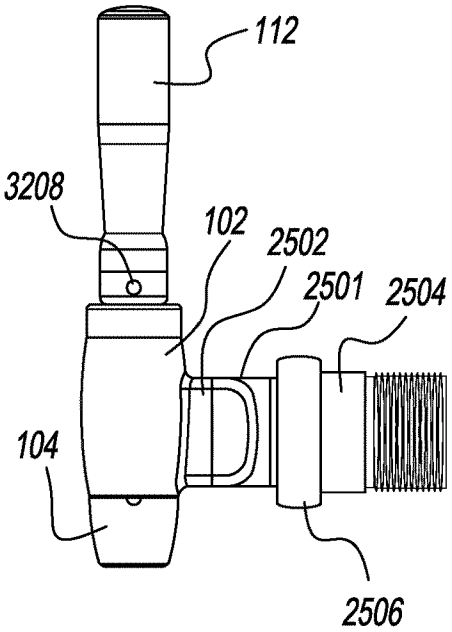
FIG. 30 is a side view of the beverage dispenser of FIG. 25 in the closed position that is a side opposite to FIG. 28.
Figure 29:
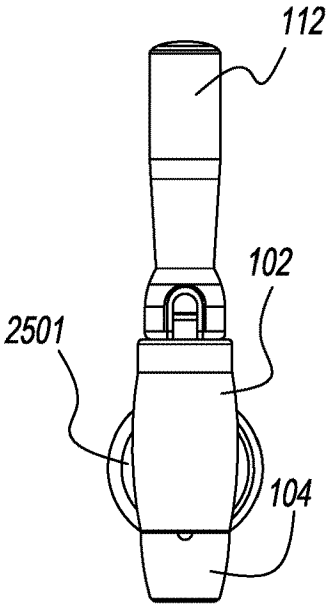
FIG. 29 is a front view of the beverage dispenser of FIG. 25 in the closed position.
Figure 36:
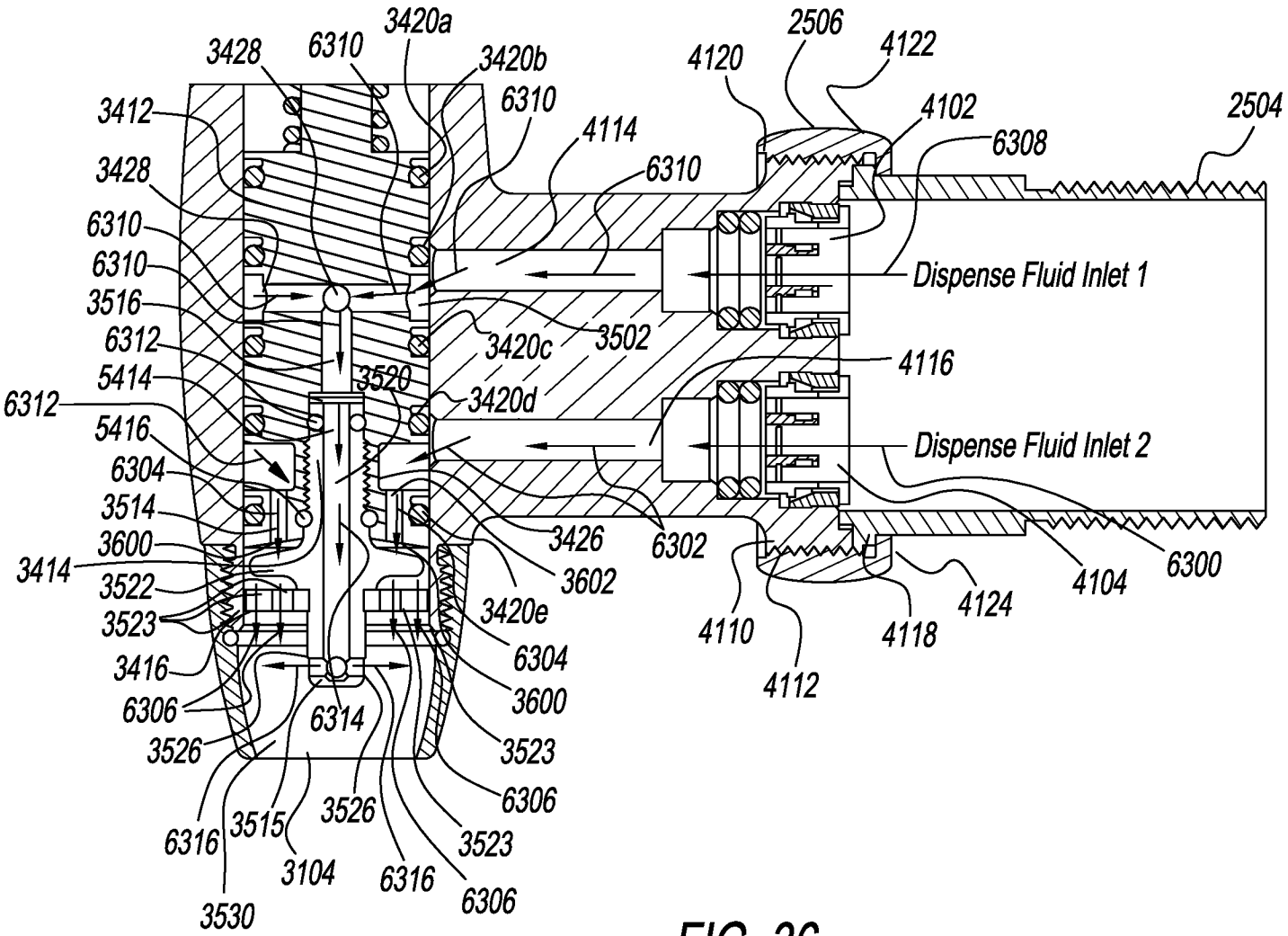
FIG. 36 is a partial side cross-sectional view of the beverage dispenser of FIG. 25 in an opened position.

Referring to FIG. 25, another embodiment of a beverage dispenser of the present disclosure is shown and referred to by reference numeral 2500. Beverage dispenser 2500 is similar to beverage dispenser 100, however, in particular, beverage dispenser 2500 has an inlet ports assembly 2501 instead of first inlet 200 and second inlet 202, and, as shown in FIG. 36, a first inlet 4102 connects to a second chamber 3516 in beverage dispenser 2500 instead of first inlet 200 connecting to first chamber 514 in beverage dispenser 100 and a second inlet 4104 connects to a first chamber 3514 in beverage dispenser 2500 instead of second inlet 202 connecting to second chamber 516 in beverage dispenser 100. Alternatively, beverage dispenser 2500 can have only one of first inlet 4102 or second inlet 4104 to dispense a single fluid, or beverage dispenser 2500 can have one or more inlets in addition to first inlet 4102 and second inlet 4104 to dispense more than two fluids.

Figure 28:
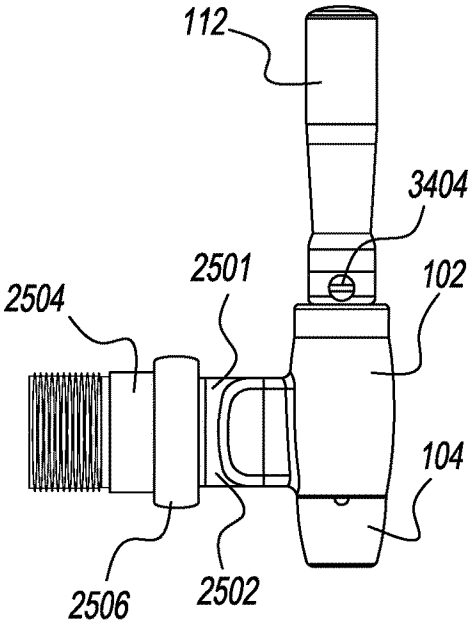
FIG. 28 is a side view of the beverage dispenser of FIG. 25 in the closed position.
Figure 27:
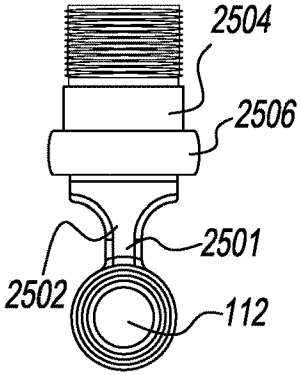
FIG. 27 is a top view of the beverage dispenser of FIG. 25 in the closed position.

Referring to FIGS. 25-30, beverage dispenser 2500 has a dispenser housing 3102. Dispenser housing 3102 is connected to a nozzle 3104 and a locking ring 3106. Beverage dispenser 2500 has a wear plate 3108 inside locking ring 3106 and a cam 3110 on wear plate 3108. Cam 3110 is connected to handle 3112. Dispenser housing 3102 has inlet ports assembly 2501. Inlet ports assembly 2501 has an inlet body 2502. Dispenser housing 3102 and inlet body 2502 are integrated as one continuous piece. Inlet body 2502 connects to a tap shank 2504 and a shank lock 2506. Tap shank 2504 and shank lock 2506 are the fastening or attachment components of beverage dispenser 2500 that removably connects beverage dispenser 2500 to dispenser assemblies, for example, shank 2504 and shank lock 2506 removably connects beverage dispenser 2500 to tower mount, font mount and counter top units. Tap shank 2504 has threads 2514 that connect to the dispenser assemblies, for example, tower mount, font mount and counter top units. Cam 3110 has a hole 3208. Beverage dispenser 2500 has a cam pin 3404 that passes through a hole in cam 3110, as shown in FIG. 28. Beverage dispenser 2500 allows integration of dispense fluid inlet ports, first inlet 4102 and second inlet 4104, into dispenser housing 3102 and separates the fastening/attachment component, tap shank 2504 and shank lock 2506, for easy installation and service accessibility. Beverage dispenser 2500 also allows an option of having different types of inlets (push to connect or barb).

Figure 31:
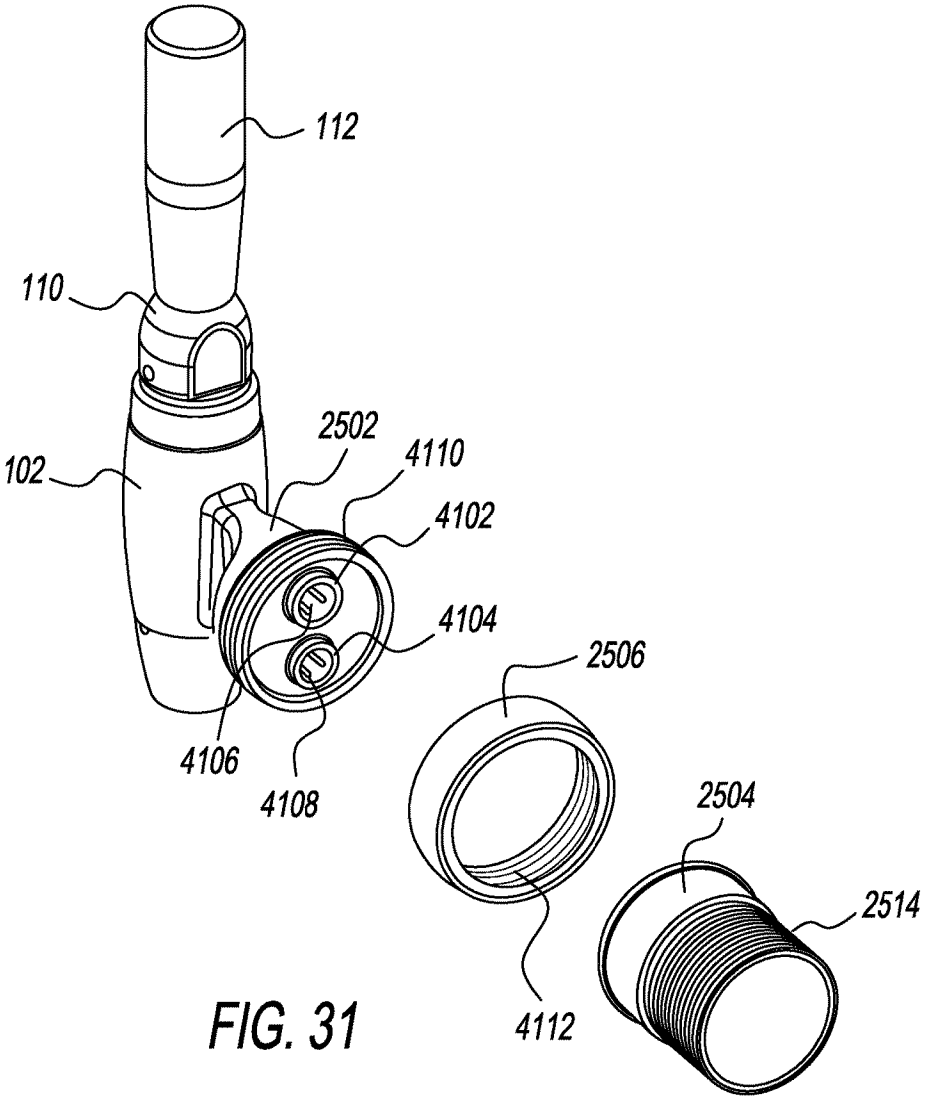
FIG. 31 is a top rear perspective view of the beverage dispenser of FIG. 25 in the closed position and having a tap shank and shank lock removed.
Figure 32:
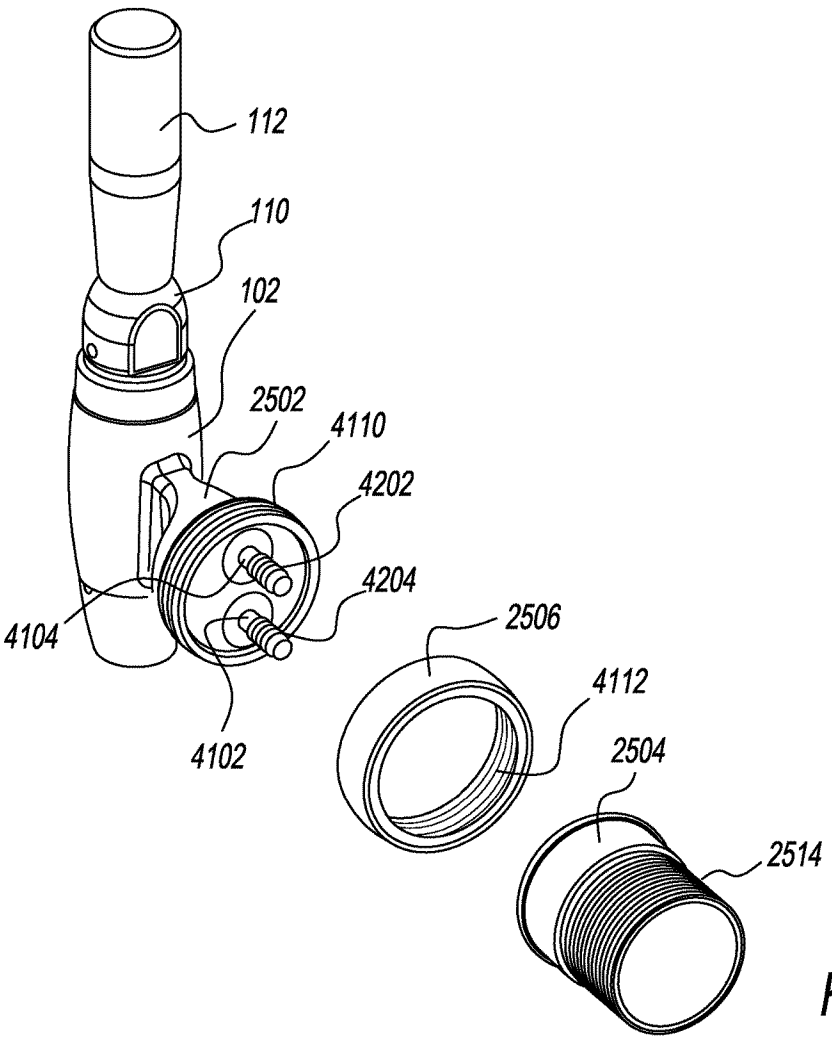
FIG. 32 is a top rear perspective view of the beverage dispenser of FIG. 25 modified to have barb inlet fittings and in the closed position having the tap shank and shank lock removed.

Referring to FIG. 31, inlet body 2502 has inlet ports 4102, 4104. For example, inlet ports 4102, 4104 are push to connect inlet ports 4106, 4108 as shown in FIG. 31 or barb fitting inlets 4202, 4204 as shown in FIG. 32. Tap shank 2504 and shank lock 2506 are removable from inlet body 2502 and connectable to inlet body 2502 by threads 4112 on shank lock 2506 that mate with threads 4110 on inlet body 2502. FIGS. 31 and 32 shown tap shank 2504 and shank lock 2506 removed from inlet body 2502 so that tap shank 2504 and shank lock 2506 are separated from inlet body 2502.

Figure 33:
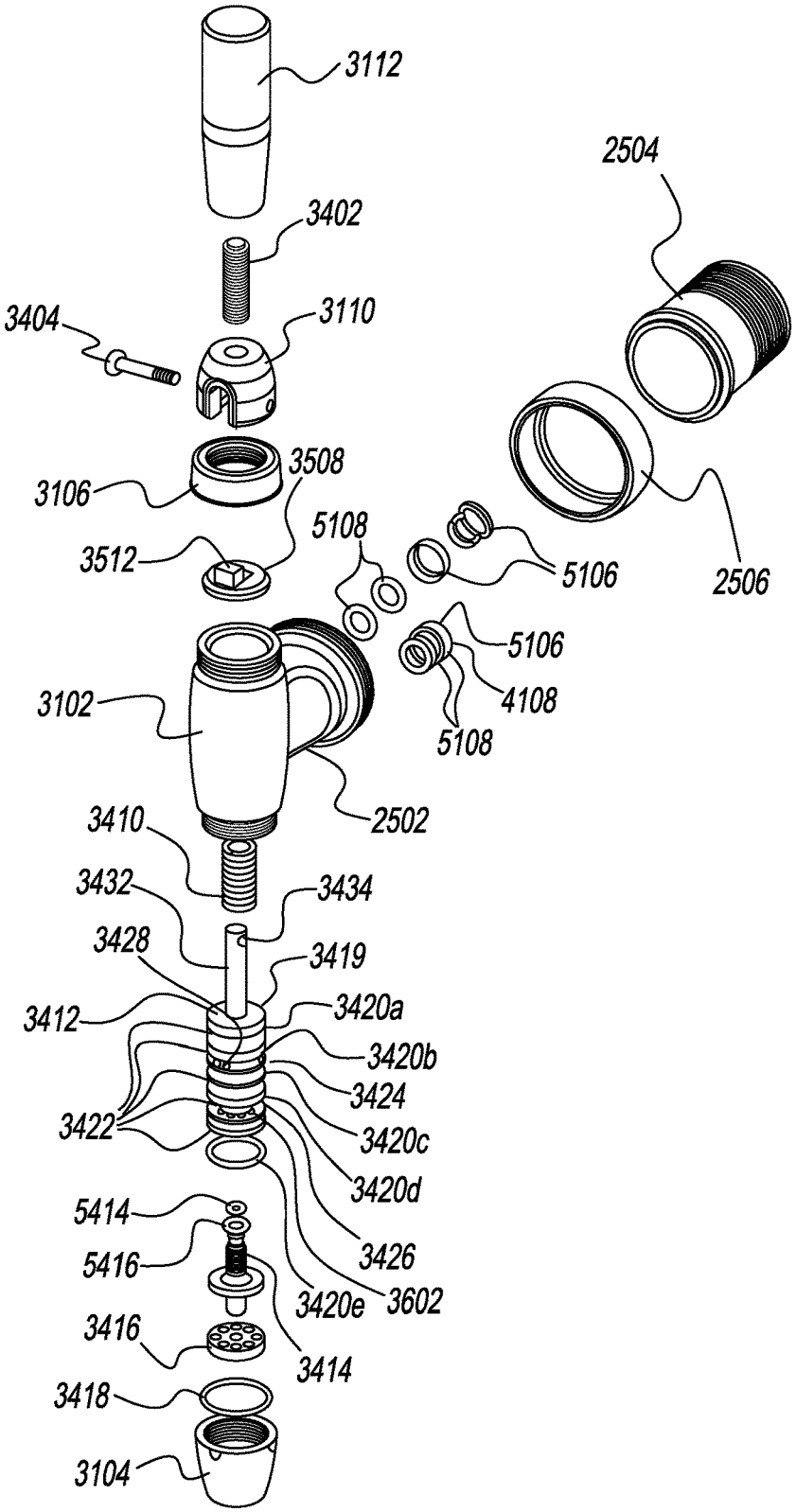
FIG. 33 is an exploded front perspective view of FIG. 25.
Figure 34:
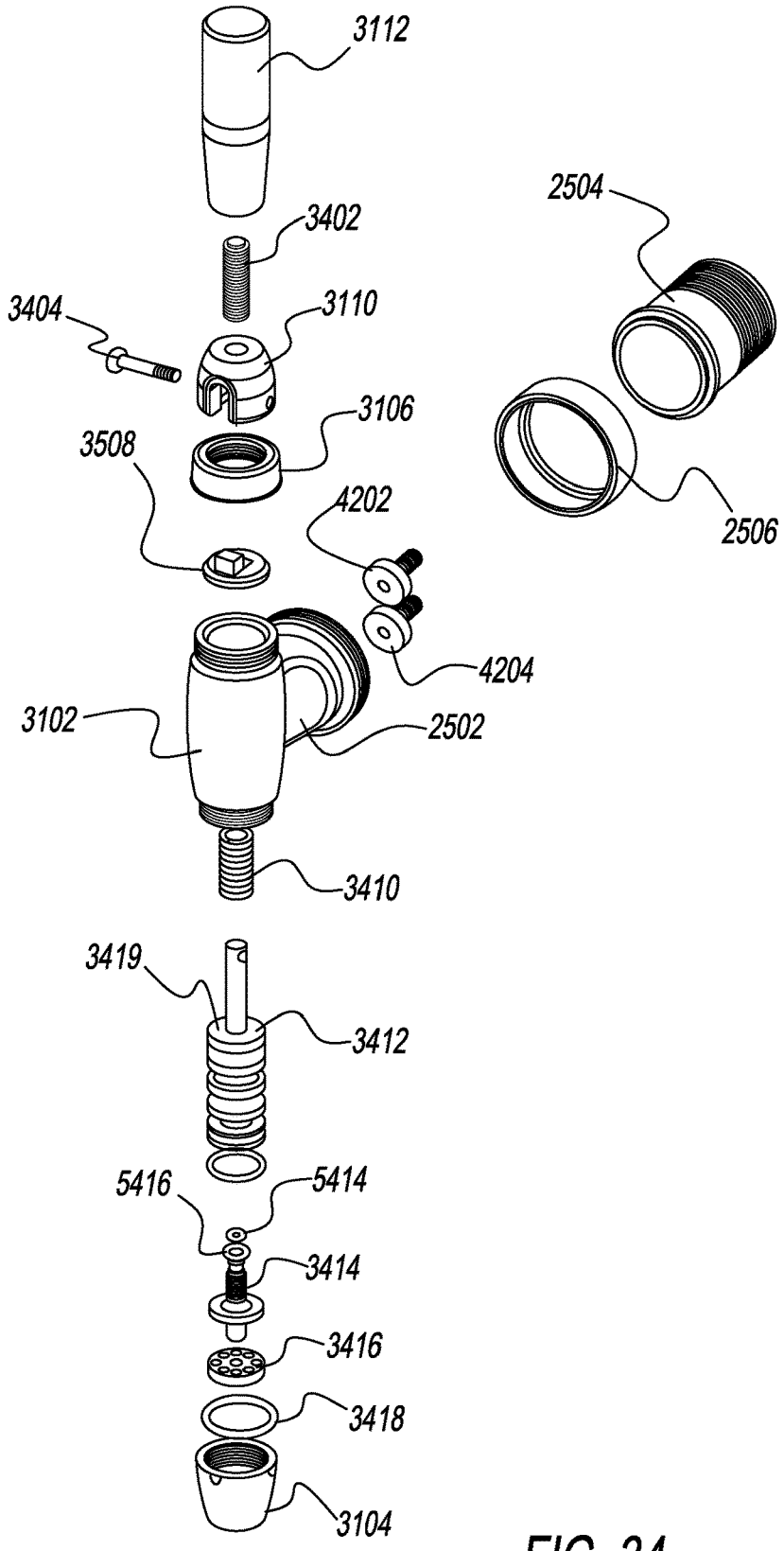
FIG. 34 is an exploded front perspective view of FIG. 32.

Referring to FIG. 33, beverage dispenser 2500 has a handle adaptor 3402, cam pin 3404, a compression spring 3410, a piston 3412, a diffuser inlet 3414, a diffuser element 3416 and a nozzle seal 3418. Push to connect inlet ports 4106, 4108 each have a push to connect assembly 5106 and two o-ring seals 5108. Alternatively, as shown in FIG. 34, beverage dispenser 2500 can have barb fitting inlets 4202, 4204 instead of push to connect inlet ports 4106, 4108. Piston 3412 has a piston body 3419. Piston body 3419 has seals 3420A, 3420B, 3420C, 3420D, 3420E and grooves 3422 that are each sized to receive one of seals 3420A, 3420B, 3420C, 3420D, 3420E by friction fit. Seals 3420A, 3420B, 3420C, 3420D, 3420E are o-ring seals. Piston body 3419 has a first depression 3424 and a second depression 3426. First depression 3424 has holes 3428. Second depression 3426 has orifices 3602. Piston body 3419 has a piston extension 3432 having an opening 3434. Beverage dispenser 2500 has o-ring seals 5414 and 5416 that fit around portions of diffuser inlet 3414.

Figure 35:
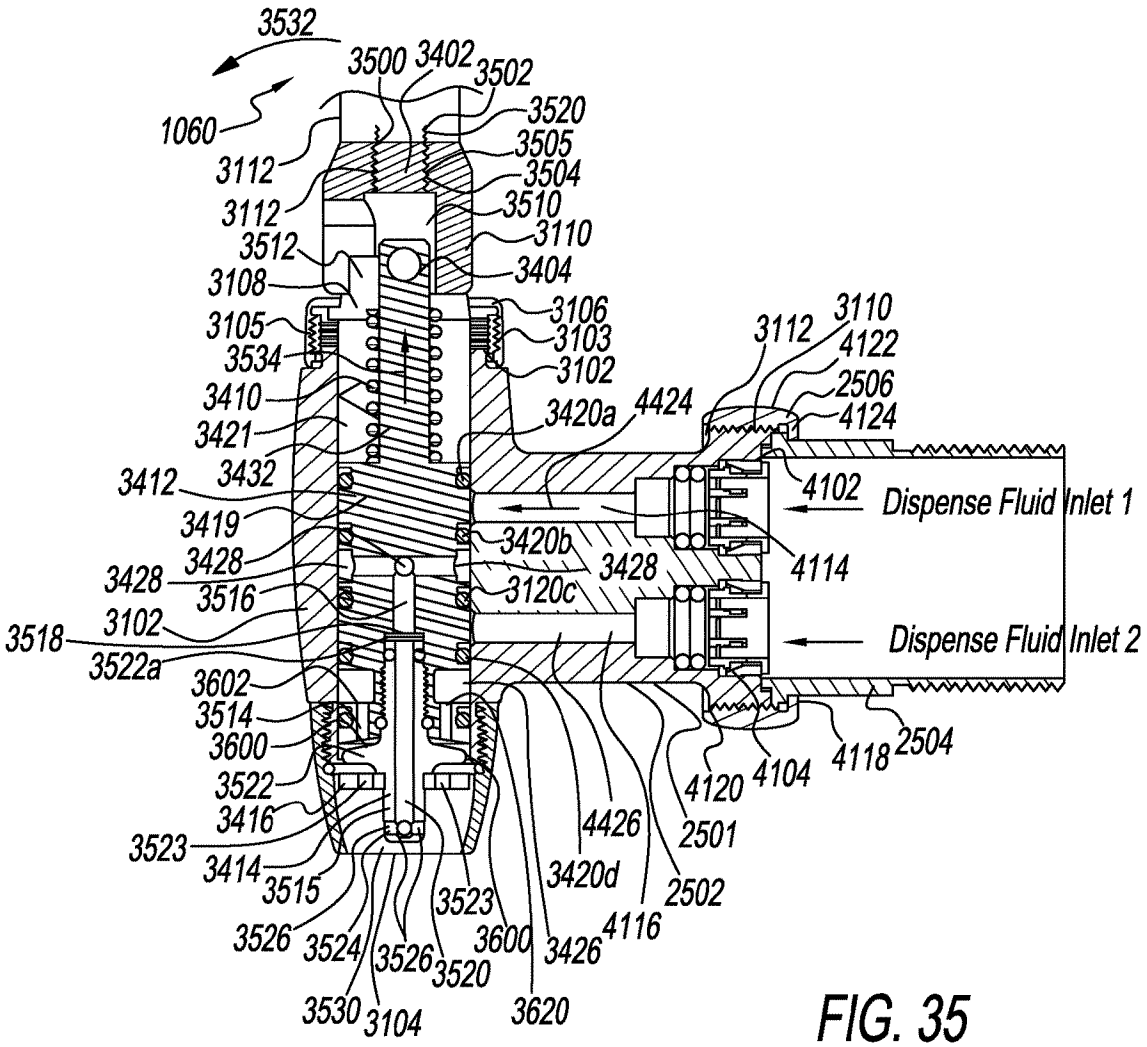
FIG. 35 is a partial side cross-sectional view of the beverage dispenser of FIG. 25 in the closed position.

Referring to FIG. 35, handle 3112 is connected to cam 3110. Handle 3112 has a cavity 3500 having threads 3502. Handle adaptor 3402 has exterior threads 3504 that engage threads 3502 to connect handle 3112 and handle adaptor 3402. Cam 3110 has an opening 3505. Exterior threads 3504 of handle adaptor 3402 passes through opening 3505 in cam 3110 to secure cam 3110 and handle 3112. Cam 3110 is positioned on locking ring 3106 and wear plate 3108. Wear plate 3108 extends through an opening in locking ring 3106 such that a portion of wear plate 3108 is in locking ring 3106 and a portion of wear plate is outside of locking ring 3106. Cam 3110 has a cavity 3510. Wear plate 3108 has a protrusion 3512 that extends into cavity 3510 of cam 3110. Locking ring 3106 connects to dispenser housing 3102 by threads 3103 that mate with threads 3105 of dispenser housing 3102 that connects wear plate 3108 to dispenser housing 3102. Cam 3110 is rotatable about cam pin 3404. Cam 3110 is rotatable on wear plate 3108. Rotation of handle 3112 in a direction 3532 rotates cam 3110.

Cam 3110 is connected to piston 3412. Piston extension 3432 extends through dispenser housing 3102, compression spring 3410, locking ring 3106, wear plate 3108 and into cavity 3510 of cam 3110. Piston extension 3432 of piston 3412 is secured to cam 3110 by cam pin 3404 that passes through hole 3208 in a first side of cam 3110, through opening 3434 in piston extension 3432, and through a hole in a second side of cam 3110 that is opposite the first side. Piston 3412 is movable in a direction 3534 in dispenser housing 3102. Compression spring 3410 biases piston 3412 in a direction opposite direction 3534 away from handle 3112. Piston body 3419 has a first chamber 3514. Piston 3412 has a second chamber 3516 through piston body 3419. Second chamber 3516 has an inlet for fluid through holes 3428 and an outlet 3518 for fluid to exit second chamber 3516. Alternatively, piston body 3419 can have only first chamber 3514 or only second chamber 3516 to dispense a single fluid, or piston body 3419 can have additional chambers in addition to first chamber 3514 and second chamber 3516 to dispense more than two fluids.

Piston body 3419 is in body chamber 3421 of dispenser housing 3102. Inlet body 2502 has inlet ports 4102, 4104. Inlet ports 4102, 4104 of inlet body 2502 connect to body chamber 3421 of dispenser housing 3102 through a first inlet chamber 4114 and a second inlet chamber 4116. In the closed position, seal 3420A is on a first side of first inlet chamber 4114 and seal 3420B is on a second side of first inlet chamber 4114 so that seals 3420A, 3420B and a surface of piston body 3419 and a surface of dispenser housing 3102 between seals 3420A, 3420B form a first plug sealing body chamber 3421 from first inlet chamber 4114. In the closed position, seal 3420C is on a first side of second inlet chamber 4116 and seal 3420D is on a second side of second inlet chamber 4116 so that seals 3420C, 3420D and a surface of piston body 3419 and a surface of dispenser housing 3102 between seals 3420C, 3420D form a second plug sealing body chamber 3421 from second inlet chamber 4116. Dispenser housing 3102 has body chamber 3421 in the middle to allow for vertical movement of piston 3412 inside beverage dispenser 2500 and mounts nozzle 3104 in the bottom. Piston 3412 is cylindrical in shape and consists of four sections: from a top section is the first plug for first inlet chamber 4114; second section is second chamber 3516 for the second fluid, the third section is the second plug for the first fluid and the fourth section is first chamber 3514 for the first fluid. Each section is sealed on both ends with o-rings of seals 3420A, 3420B, 3420C, 3420D, 3420E as described herein.

Diffuser inlet 3414 has a stem 3515 that connects to piston body 3419 inside of second chamber 3516. Diffuser inlet 3414 connects to piston body 3419, for example, by snap fit. Diffuser inlet 3414 forms a passage 3520 in stem 3515 that is in fluid communication with second chamber 3516. Passage 3520 has an inlet 3522*a* and an outlet 3524. Outlet 3524 has four orifice holes 3526 that each have a center axis angled at 90 degrees. Diffuser inlet 3414 forms a disc 3522 that extends outward from stem 3515. Diffuser element 3416 connects to stem 3515 on a side of disc 3522 opposite to piston 3412. Diffuser inlet 3414 connects to diffuser element 3416, for example, by snap fit. Diffuser element 3416 has holes 3523 to control distribution of fluid through diffuser element 3416.

Piston extension 3432 of piston 3412 is mechanically linked to cam 3110 using cam pin 3404. Cam 3110 slides on wear plate 3108 which acts as a bearing surface for cam 3110. Wear plate 3108 is arrested in place between dispenser housing 3102 and locking ring 106. Piston 3412 also has compression spring 3410 to help return piston 3412 back to a return position and proper sealing when in the closed position. Cam 3110 also holds handle 3112 on using a threaded handle adaptor 3402 that may be changed to different sizes to allow flexibility of changing the handles with different logos.

First chamber 3514 has an inlet for fluid through second depression 3426 and an outlet 3600 for fluid to exit first chamber 3514. Second depression 3426 can be so that the first fluid entering second depression 3426 is placed perpendicular to orifices 3602 of first chamber 3514. The first fluid is directed to be dispensed from first chamber 3514 between piston 3412 and diffuser inlet 3414. Each of orifices 3602 can have a separate first chamber 3514 that each have one of outlets 3600, or first chamber 3514 can be common to one or more of orifices 3602.

The closed position of beverage dispenser 2500 is shown in FIGS. 25-32 and 35. Referring back to FIG. 35, seal 3420A being on the first side of first inlet chamber 4114 and seal 3420B being on the second side of first inlet chamber 4114 so that seals 3420A, 3420B and the surface of piston body 3419 and the surface of dispenser housing 3102 between seals 3420A, 3420B form the plug sealing body chamber 3421 from first inlet chamber 4114 to block first inlet chamber 4114 from fluid communication with second chamber 3516. Seal 3420C being on the first side of second inlet chamber 4116 and seal 3420D being on the second side of second inlet chamber 4116 so that seals 3420C, 3420D and the surface of piston body 3419 and the surface of dispenser housing 102 between seals 3420C, 3420D form the plug sealing body chamber 3421 from second inlet chamber 4116 to block second inlet chamber 4116 from fluid communication with first chamber 3514. Accordingly, in the closed position, handle 3112 maintains piston 3412 in a position to seal first inlet chamber 4114 from fluid communication with second chamber 3516 and second inlet chamber 4116 from fluid communication with first chamber 3514 to block flow of the first fluid, as shown by arrow 4424, and flow of the second fluid, as shown by arrow 4426, out of dispenser outlet 3530.

A force is applied to handle 3112 to rotate of handle 3112 and cam 3110 in direction 3532 moves dispenser 2500 from the closed position shown in FIGS. 25-32 and 35 to an open position shown in FIG. 36. Rotation of handle 3112 and cam 3110 from the closed position to the open position moves piston 3412 linearly in direction 3534 by cam 3110 rotating on wear plate 3108 to move cam pin 3404 away from dispenser housing 3102 that also moves piston extension 3432 in direction 3534. A shape of cam 3110 and wear plate 3108 direct rotation and a distance that piston 3412 is moved in direction 3534. Wear plate 3108 has protrusion 3512 that extends into cavity 3510 of cam 3110 to direct rotation of cam 3110. When handle 3112 is pulled in direction 3532 the orientation of cam 3110 changes thereby translating rotary motion into linear motion and exposing first inlet chamber 4114 to second chamber 3516 and second inlet chamber 4116 to first chamber 3514.

Referring to FIG. 36, in the open position, seal 3420B is on the first side of first inlet chamber 4114 and seal 3420C is on the second side of first inlet chamber 4114 so that holes 3428 are placed in fluid communication with first inlet chamber 4114. In the open position, seal 3420D is on the first side of second inlet chamber 4116 and seal 3420E is on a second side of second inlet chamber 4116 so that second depression 3426 is in fluid communication with second inlet chamber 4116.

Tap shank 2504 and shank lock 2506 are the fastening or attachment components of beverage dispenser 2500 that removably connects beverage dispenser 2500 to dispenser assemblies. For example, shank 2504 and shank lock 2506 removably connects beverage dispenser 2500 to tower mount, font mount and counter top units. Tap shank 2504 is a tube shape. Tap shank 2504 has threads 2514 that connect to the dispenser assemblies, for example, tower mount, font mount and counter top units. Dispenser housing 3102 is connected to nozzle 3104, for example, by snap fit. Dispenser housing 3102 and nozzle 3104 form a dispenser outlet 3530. Dispenser housing 3102 connects to tap shank 2504 by shank lock 2506. Shank lock 2506 has a ring shape with an interior surface 4120 and an exterior surface 4122. Shank lock 2506 has a ridge 4124 extending from interior surface 4120. Shank lock 2506 fits over tap shank 2504 to position ridge 4124 against ridge 4118 formed on tap shank 2504. Threads 4112 on shank lock 2506 mate with threads 4110 on inlet body 2502 to connect tap shank 2504 and dispenser housing 3102.

In operation, when beverage dispenser 2500 is in the open position, a first fluid source to provide a flow of the first fluid is connected to second inlet 4104. The first fluid flows into second inlet chamber 4116 through second inlet 4104 as shown by arrow 6300. The first fluid flows from second inlet 4104 into dispenser housing 3102 and through second depression 3426 into piston 3412 as shown by arrow 6302 and orifices 3602 into first chamber 3514 in piston 3412 that is perpendicular to second depression 3426. The first fluid flows through first chamber 3514 toward outlet 3600 as shown by arrows 6304. A number of orifices 3602 and a size of orifices 3602 can be varied to achieve different characteristics from different types of the beverages. For example, smaller orifice size for nitrogen infused beverages will provide more creamy texture; slightly larger orifice size provides more gas retention for Co2 infused beverages.

The first fluid flows from first chamber 3514 out of outlet 3600 into dispenser housing 3102 around disc 3522 of diffuser inlet 3414 and through holes 3523 of diffuser element 3416 as shown by arrows 6306. The first fluid flows from diffuser element 3416 toward dispenser outlet 3530. A distance between outlet 3600 and disc 3522 is critical to retain a desired pressure and flow characteristics of the first fluid. This distance between outlet 3600 and disc 3522 can be modified depending on different types of the first fluid.

A second fluid source to provide a flow of the second fluid is connected to first inlet 4102. The second fluid flows into first inlet chamber 4114 from first inlet 4102 as shown by arrow 6308. The second fluid flows from first inlet chamber 4114 into dispenser housing 3102 and through holes 3428 into piston 3412 as shown by arrows 6310 into second chamber 3516 in piston 3412. The second fluid flows through second chamber 3516 into passage 3520 of diffuser inlet 3414 as shown by arrow 6312. The second fluid flows through passage 3520 of diffuser inlet 3414 toward orifice holes 3526 of outlet 3524 as shown by arrows 6314. The second fluid flows through orifice holes 3526 from passage 3520 as shown by arrows 6316 and sprayed into the first fluid mixing the first fluid and the second fluid prior to exiting beverage dispenser 2500 through dispenser outlet 3530. Accordingly, the second fluid from first inlet 4102 enters second chamber 3516 through holes 3428 that allow the second fluid to be dispensed from a center on piston 3412 through diffuser inlet 3414.

A diffuser assembly has three sections, disc 3522 of diffuser inlet 3414, diffuser element 3416 and stem 3515 of diffuser inlet 3414. The disc 3522 is located underneath outlet 3600 for the first fluid from piston 3412. Disc 3522 has radial and angular geometric features to allow the first fluid to cascade without creating turbulence in the first fluid. The first fluid then cascades onto diffuser element 3416, which has holes 3523, shown as several small holes, that allows the first fluid to be equally distributed in the pour during dispense from of nozzle 3104 and proper mixing with the second fluid.

Stem 3515 has a thru hole for outlet 3524 with orifice holes 3526 on the bottom angled at 90 degrees. This allows the second fluid to be sprayed as small particles in to the stream of the first fluid right before being dispensed out of beverage dispenser 2500. This allows for good mixing of the second fluid in the first fluid's flow path and proper stratification of the final dispensed product. The number of orifice holes 3526, size of orifice holes 3526 and angles of orifice holes 3526 can be varied in stem 3515 for different beverages (syrup vs juice vs coffee or any type of mixed beverages including alcohol) to achieve different characteristics and to accommodate for different particle sizes in the first fluid and/or the second. Particles are, for example, pulp in orange juice, that can become jammed or clogged in orifice holes 3526. This allows the tap to dispense fluids and mixing them right before dispensing from the tap outlet when dispensing more than one fluid. This avoids the excess loss of carbonation and foaming which will occur when premixing the beverages in traditional taps/faucets. Piston 3412 is mounted with a diffuser assembly, diffuser inlet 3414 and diffuser element 3416, and dispenser housing 3102 with a nozzle 3104. Both the diffuser assembly and nozzle 3104 help the dispense beverage performance and flow characteristics during dispense state in operation of the open position. Nozzle seal 3418 and o-ring seals 5414 and 5416 of the diffuser assembly are o-rings that are used for sealing both the components to their respective assemblies. O-ring seals 5414 and 5416 are between diffuser inlet 3414 and piston 3412 inside second chamber 3516.

Referring back to FIG. 35, during operation, after dispense of the desired amount of the first fluid and the second fluid, handle 3112 and cam 3110 can be rotated in direction 1000 to return beverage dispenser 2500 back to the closed position shown in FIGS. 25-32 and 35. Compression spring 3410 exerts a force on piston 3412 so that a lower force is need to be applied to handle 3112 to rotate handle in direction 1000 from the open position to the closed position. Alternatively, one or more seals, for example, seals 3420A, 3420B, 3420C, 3420D, 3420E, can be positioned on piston 3412 so that handle 3112 can be configured to rotate to different positions, for example, by rotation forward and/or backward and/or to the left side and/or to the right side, moving piston 3412 in dispenser housing 3102 between one or more open positions and one or more closed positions where motion of piston 3412 is variable in direction and distance in each of the one or more open positions and the one or more closed positions to allow or block fluid communication between first inlet 4102, second inlet 4104 and one or more inlets to first chamber 3514, second chamber 3516, and one or more additional chambers, respectively, in different combinations allowing dispense of the first fluid, the second fluid and the one or more additional fluids in different combinations for each of the one or more open positions and the one or more closed positions.

Beverage dispenser 2500 will provide distinctive look and still provide a good performance beverage and a more premium user experience. Dispenser housing 3102 is cylindrical in shape with first inlet 4102 and second inlet 4104 located on a back side. The external tap profile of beverage dispenser 2500 can be in several different shapes based on customer requirements. Beverage dispenser 2500 is more compact than beverage dispenser blocks typically in service and used directly by the consumer. First inlet 4102 on the top dispenses the second fluid and second inlet 4104 in the bottom dispenses the first fluid. First inlet 4102 and second inlet 4104 can be reversed as well, so that first inlet 4102 on the top dispenses the first fluid and second inlet 4104 on the bottom dispense the second fluid; however, dimensions of beverage dispenser 2500 may need to be modified accordingly. Beverage dispenser 2500 provides an alternate configuration from beverage dispenser 100. Beverage dispenser 2500 can have a syrup inlet for first inlet 4102 on the top and water inlet for second inlet 4104 on the bottom. With the syrup inlet for first inlet 4102 on the top and the water inlet for carbonated water for second inlet 4104 on the bottom less carbonation is lost than if the water inlet for carbonated water is first inlet 4102. This carbonation retention can be better than beverage dispenser 100 where carbonated water enters piston 412 through first inlet 200.

Figure 37:
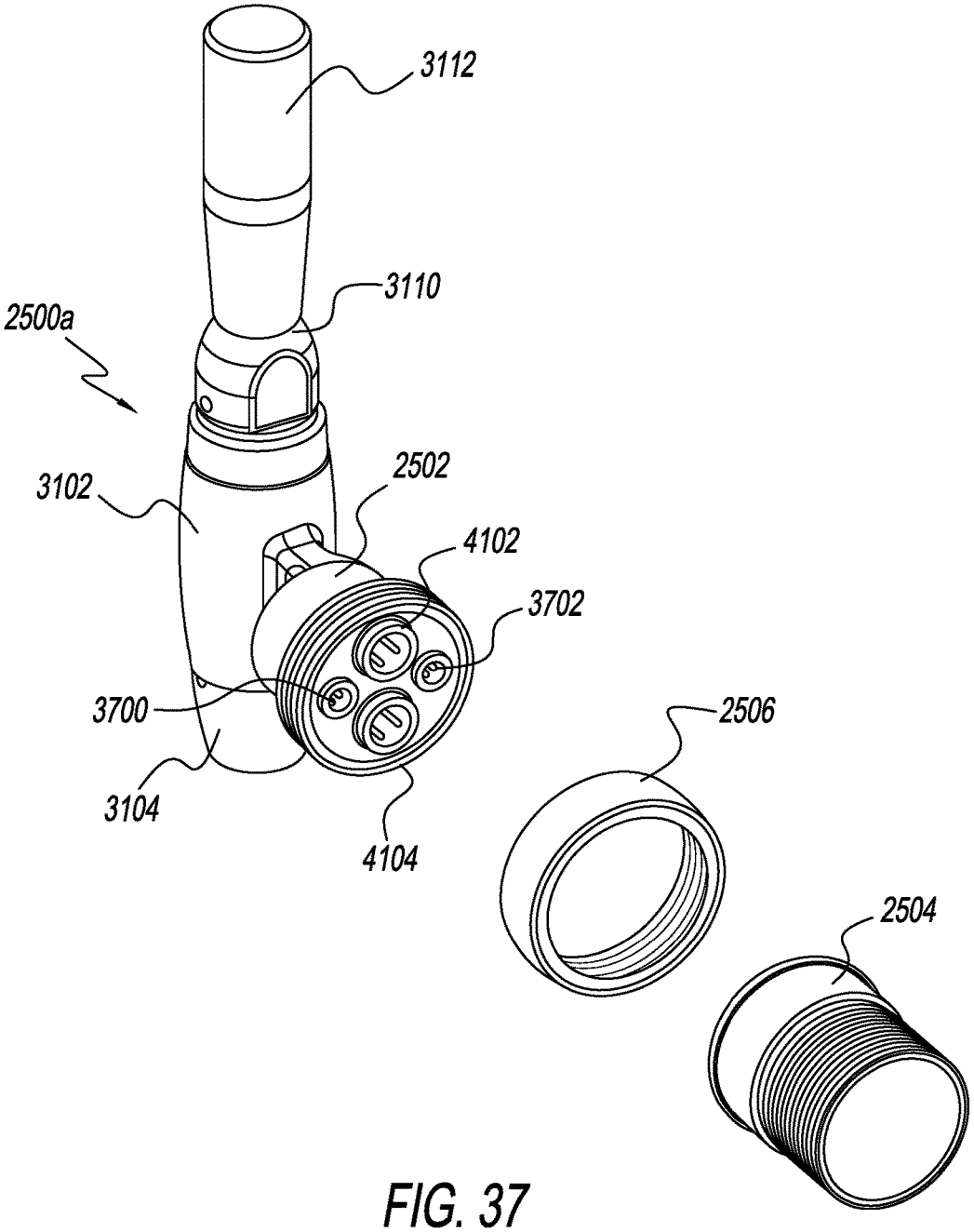
FIG. 37 is a top rear perspective view of the beverage dispenser of FIG. 25 modified to have a first recirculation fitting, a second recirculation fitting and passage, and in the closed position having a tap shank and shank lock removed.
Figure 38:
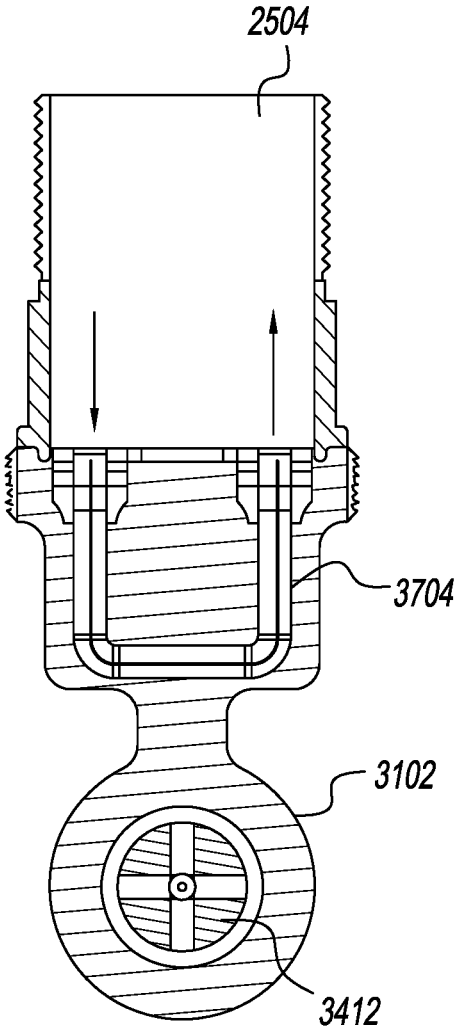
FIG. 38 is a top cross-sectional view of the beverage dispenser of FIG. 37.

Referring to FIG. 37, beverage dispenser 2500A is shown. Beverage dispenser 2500A is the same as beverage dispenser 2500 except modified to add a first recirculation fitting 3700, a second recirculation fitting 3702 and passage 3704, shown in FIG. 38, in inlet body 2502. Components of beverage dispenser 2500A that are the same as beverage dispenser 2500 are referenced using the same reference numerals herein. FIGS. 37-38 show beverage dispenser 2500A in the closed position and having tap shank 2504 and shank lock 2506 removed. Referring to FIG. 38, passage 3704 is a chamber that extends from first recirculation fitting 3700 to second recirculation fitting 3702.

Figure 39:
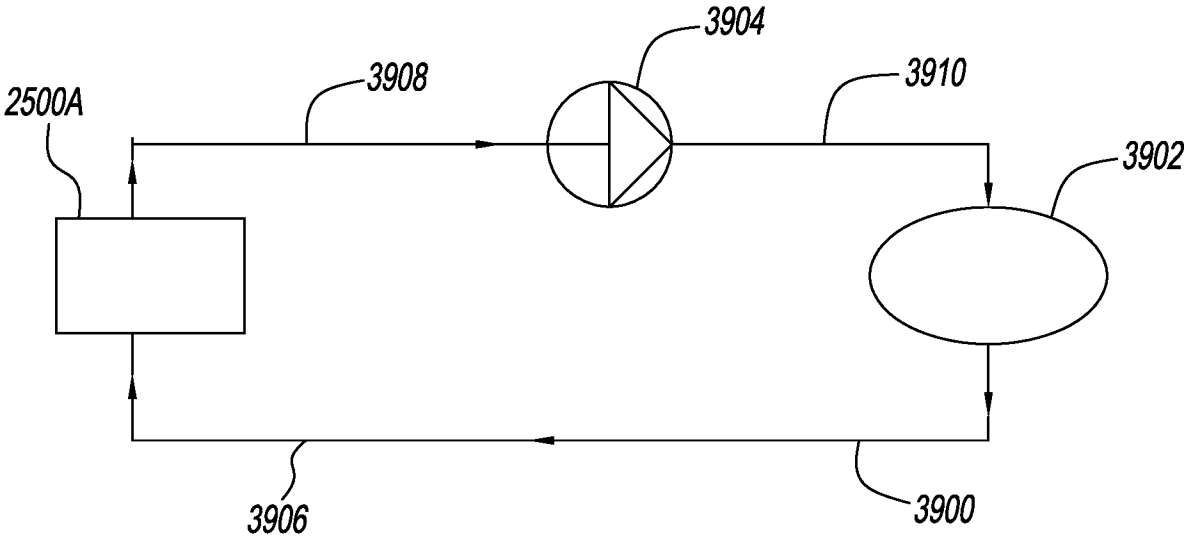
FIG. 39 is a schematic diagram of a recirculation system connected to the beverage dispenser of FIG. 37.

Referring to FIG. 39, during operation, beverage dispenser 2500A is connected to a recirculation system 3900. Recirculation system 3900 includes a heat exchanger 3902, a pump 3904, a delivery conduit 3906, a first return conduit 3908, and a second return conduit 3910.

In operation, delivery conduit 3906 is connected to first recirculation fitting 3700 and first return conduit 3908 is connected to second recirculation fitting 3702. Pump 3904 circulates a cooling medium through recirculation system 3900 and beverage dispenser 2500A so that the cooling medium passes through heat exchanger 3902 to cool the cooling medium prior to entering beverage dispenser 2500A through first recirculation fitting 3700 from delivery conduit 3906. The cooling medium passes through passage 3704 to cool beverage dispenser 2500A. The cooling medium passes out of passage 3704 through second recirculation fitting 3702 into first return conduit 3908 to pump 3904. Pump 3904 generates a flow of the cooling medium from pump 3904 to back to heat exchanger 3902 so that the cooling medium can be continuously circulated through recirculation system 3900 and beverage dispenser 2500A during operation.

Beverages can be stagnant in taps for extended durations of time that will have deteriorated performance and temperature and render some beverages unsafe to consume, for example, milk. The addition of first recirculation fitting 3700, second recirculation fitting 3702 and passage 3704, where passage 3704 passes through dispenser housing 3102 allows for circulation of cold fluids to consistently maintain the temperature of the beverages. The cooling medium can be a cooled refrigerant, the first fluid that is dispensed from beverage dispenser 2500A or the second fluid that is dispensed from beverage dispenser 2500A. If the cooling medium is a cooled refrigerant, then recirculation system 3900 is a closed system that isolates the cooling medium from the first fluid and the second fluid that are dispensed from beverage dispenser 2500A. Passage 3704 between first recirculation fitting 3700 and second recirculation fitting 3702 can be a U-shaped, V-shaped or combination with multiple loops inside the tap body. Similar to first inlet 4102 and second inlet 4104, first recirculation fitting 3700 and second recirculation fitting 3702 can be push to connect or barb fitments.

The present disclosure having been thus described with particular reference to the preferred forms thereof, it will be obvious that various changes and modifications may be made therein without departing from the spirit and scope of the present invention as defined in the appended claims.

It should be noted that the terms "first", "second", "third", "fourth", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure will not be limited to the particular embodiment(s) disclosed as the best mode contemplated, but that the disclosure will include all embodiments falling within the scope of the appended claims.

The invention claimed is:

1. A beverage dispenser comprising:

a dispenser housing having a first inlet and a second inlet;

a piston being disposed in said dispenser housing, said piston having a first chamber extending through said piston and a second chamber extending through said piston, said piston being movable in said dispenser housing between an open position and a closed position, wherein the piston has one or more holes forming a first chamber inlet to said first chamber so that a first fluid flows through the one or more holes of the first inlet into the first chamber that is in said piston and the piston has one or more holes forming a second chamber inlet so that a second fluid flows through the one or more holes of the second inlet into the second chamber that is in said piston, wherein said first inlet is in fluid communication with said first chamber inlet when in said open position and said second inlet is in fluid communication with said second chamber inlet when in said open position, and wherein said first inlet is blocked from fluid communication with said first chamber inlet in said closed position and said second inlet is blocked from fluid communication with said second chamber inlet in said closed position.

2. The beverage dispenser of claim 1, wherein said dispenser housing has an interior chamber allowing for movement of said piston by a handle extending from said interior chamber between said open position and said closed position, wherein said piston is connected to a cam extending from said dispenser housing, and wherein, when the handle is rotated from a first orientation in said closed position, said cam moves to translate rotary motion into linear motion to move said piston to a second orientation in said open position.

3. The beverage dispenser of claim 2, wherein said piston is connected to said cam by a pin, wherein said cam slides on a wear plate which acts as a bearing surface for said cam, further comprising a compression spring between said piston and said handle biasing said piston to said closed position.

4. The beverage dispenser of claim 1, wherein said piston forms a first plug by positioning a seal above said first inlet and a seal below said first inlet to block flow of said first fluid when in said closed position and said piston forms a second plug by positioning a seal above said second inlet and a seal below said second inlet to block flow of said second fluid when in said closed position.

5. The beverage dispenser of claim 4, wherein said first plug and said second plug are movable with said piston from said closed position to said open position where said first plug is moved out of alignment with said first inlet allowing flow of said first fluid through said first inlet into said first chamber inlet and said second plug is moved out of alignment with said second inlet allowing flow of said second fluid through said second body inlet into said second chamber inlet.

6. The beverage dispenser of claim 1, wherein said piston has a handle on a first end and a diffuser assembly on a second end opposite said first end.

7. The beverage dispenser of claim 1, wherein one of said first chamber and said second chamber dispenses from a stem connected to said piston, and said stem has a through hole with one or more orifice holes.

8. A beverage dispenser comprising:

a dispenser housing having a first inlet, a second inlet, and a body outlet, said first inlet receiving a first fluid, and said second inlet receiving a second fluid;

a piston being in said dispenser housing, said piston being movable in said dispenser housing between an open position and a closed position, said first inlet and said second inlet both being in fluid communication with said body outlet when in said open position, and said first inlet and said second inlet both being blocked from fluid communication with said body outlet when in said closed position, and said second fluid being sprayed into a stream of said first fluid mixing said first fluid and said second fluid prior to exiting said dispenser housing through said body outlet, wherein the dispenser housing has a recirculation chamber, and wherein the dispenser housing has recirculation ports on opposite sides of the recirculation chamber.

* * * * *